US011069471B2

(12) United States Patent
Hirabayashi et al.

(10) Patent No.: US 11,069,471 B2
(45) Date of Patent: Jul. 20, 2021

(54) REACTOR

(71) Applicants: AUTONETWORKS TECHNOLOGIES, LTD., Yokkaichi (JP); SUMITOMO WIRING SYSTEMS, LIMITED, Yokkaichi (JP); SUMITOMO ELECTRIC INDUSTRIES, LTD., Osaka (JP)

(72) Inventors: Tatsuo Hirabayashi, Yokkaichi (JP); Masayuki Kato, Yokkaichi (JP); Takashi Misaki, Yokkaichi (JP); Seiji Shitama, Yokkaichi (JP); Shinichiro Yamamoto, Yokkaichi (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 588 days.

(21) Appl. No.: 16/069,481

(22) PCT Filed: Jan. 26, 2017

(86) PCT No.: PCT/JP2017/002827
§ 371 (c)(1),
(2) Date: Jul. 11, 2018

(87) PCT Pub. No.: WO2017/131122
PCT Pub. Date: Aug. 3, 2017

(65) Prior Publication Data

US 2019/0027295 A1 Jan. 24, 2019

(30) Foreign Application Priority Data

Jan. 29, 2016 (JP) ..... JP2016-016034
May 26, 2016 (JP) ..... 2016-105073

(51) Int. Cl.
*H01F 27/24* (2006.01)
*H01F 27/26* (2006.01)
(Continued)

(52) U.S. Cl.
CPC ..... *H01F 27/263* (2013.01); *H01F 3/14* (2013.01); *H01F 27/022* (2013.01);
(Continued)

(58) Field of Classification Search
USPC ..... 336/212, 90, 65, 221, 178, 210
See application file for complete search history.

(56) References Cited

U.S. PATENT DOCUMENTS 8,558,651 B2 * 10/2013 Suzuki ..... H01F 27/266 336/182
9,099,236 B2 * 8/2015 Nomura ..... H01F 27/025
(Continued)

FOREIGN PATENT DOCUMENTS

JP H08-017649 A 1/1996
JP 2012-248904 A 12/2012
(Continued)

OTHER PUBLICATIONS

Apr. 25, 2017 International Search Report issued in International Patent Application No. PCT/JP2017/002827.

*Primary Examiner* — Shawki S Ismail
*Assistant Examiner* — Kazi S Hossain
(74) *Attorney, Agent, or Firm* — Oliff PLC

(57) ABSTRACT

A reactor that includes a coil that includes a winding portion; a magnetic core that includes a plurality of core pieces that are located inside and outside the winding portion, and one or more gap portions that are interposed between core pieces that are adjacent to each other; an interposed member that is interposed between the coil and the magnetic core; and a resin mold portion that covers at least a portion of an outer
(Continued)

circumferential surface of the magnetic core without covering an outer circumferential surface of the winding portion so that the outer circumferential surface of the winding portion is exposed.

5 Claims, 11 Drawing Sheets

(51) Int. Cl.

| | |
|---|---|
| ***H01F 37/00*** | (2006.01) |
| ***H01F 27/255*** | (2006.01) |
| ***H01F 27/02*** | (2006.01) |
| ***H01F 27/32*** | (2006.01) |
| ***H01F 3/14*** | (2006.01) |
| ***H01F 41/063*** | (2016.01) |
| ***H01F 27/28*** | (2006.01) |
| ***H01F 41/02*** | (2006.01) |

(52) U.S. Cl.
CPC ..... *H01F 27/255* (2013.01); *H01F 27/2823* (2013.01); *H01F 27/324* (2013.01); *H01F 37/00* (2013.01); *H01F 41/0246* (2013.01); *H01F 41/063* (2016.01); *H01F 27/2847* (2013.01)

(56) References Cited

U.S. PATENT DOCUMENTS

| | | | | |
|---|---|---|---|---|
| 2013/0106556 | A1* | 5/2013 | Suzuki | H01F 27/306 336/212 |
| 2016/0322150 | A1* | 11/2016 | Inaba | H01F 27/2823 |
| 2017/0053731 | A1 | 2/2017 | Misaki et al. | |

FOREIGN PATENT DOCUMENTS

| | | | |
|---|---|---|---|
| JP | 2014-078684 | A | 5/2014 |
| JP | 2014-143332 | A | 8/2014 |
| JP | 2015-188019 | A | 10/2015 |

* cited by examiner

51:510, 515

REACTOR

BACKGROUND

The present application is the U.S. National Phase of PCT/JP2017/002827 filed Jan. 26, 2017, which claims priority to Japanese Patent Application No. 2016-016034 filed on Jan. 29, 2016 and Japanese Patent Application No. 2016-105073 filed on May 26, 2016, the disclosures of which are hereby incorporated in their entirety by reference.

The present disclosure relates to a reactor.

JP 2012-248904A discloses, as a reactor for an on-board converter, a reactor that includes: a coil that includes a pair of winding portions (a first coil portion and a second coil portion) that are formed by spirally winding a winding wire; a ring-shaped magnetic core (a core) that is provided inside and outside the winding portions; tubular bobbins that are interposed between the winding portions and the magnetic core; and frame bobbins that are located on two ends of the winding portions.

The above-described magnetic core includes a plurality of core pieces and gap plates that are made of alumina or the like and are each interposed between core pieces that are adjacent to each other. Portions of the above-described magnetic core located inside the winding portions are stacked objects in which an intermediate core piece (corresponding to an inner core piece) and a gap plate are stacked one after the other. The above-described tubular bobbins are interposed between the inner circumferential surfaces of the winding portions and the above-described stacked objects. The tubular bobbins are formed so as to be tubular by engaging a pair of divisional pieces, which are split in two in a direction that is orthogonal to the axial direction of the winding portions, with each other, and cover the entire outer circumferential surfaces of the above-described stacked objects (hereinafter, the tubular bobbins are referred to as the conventional tubular bobbins). The frame bobbins are interposed between end surfaces of the winding portions and end portion core pieces (corresponding to outer core pieces) that are located outside the winding portions, and are provided with a pair of through holes through which the stacked objects are inserted. In addition, JP 2012-248904A discloses, for example, achieving mechanical protection using resin to cover a combined body that includes the above-described coil, the above-described magnetic core, the tubular bobbins, and the frame bobbins.

SUMMARY

A reactor according to the present disclosure includes: a coil that includes a winding portion; a magnetic core that includes a plurality of core pieces that are located inside and outside the winding portion, and one or more gap portions that are interposed between core pieces that are adjacent to each other; an interposed member that is interposed between the coil and the magnetic core; and a resin mold portion that covers at least a portion of an outer circumferential surface of the magnetic core without covering an outer circumferential surface of the winding portion so that the outer circumferential surface of the winding portion is exposed. The interposed member includes: a plurality of inner divisional pieces that are interposed between an inner circumferential surface of the winding portion and an outer circumferential surface of the magnetic core, and are located so as to be separated from each other in an axial direction of the winding portion; and a frame plate portion that is independent of the inner divisional pieces, and is interposed between an end surface of the winding portion and an outer core piece included in the magnetic core, the outer core piece being located outside the winding portion. The plurality of inner divisional pieces include: at least one intermediate divisional piece that is located at an intermediate position in an axial direction of the winding portion, keeps an interval between the core pieces that are adjacent to each other, and is provided with interposed protruding portions that form at least one of the gap portions; and a pair of end portion divisional pieces that sandwich the intermediate divisional piece and are located at end surface sides of the winding portion. The intermediate divisional piece includes: a body portion that continuously covers portions of the outer circumferential surfaces of the core pieces that are adjacent to each other, the interposed protruding portions standing upright on an inner circumferential surface of the body portion; and a cutout portion from which the outer circumferential surfaces of the core pieces that are adjacent to each other are partially exposed so that the body portion is disconnected in a circumferential direction of the outer circumferential surfaces. The end portion divisional pieces are each provided with: a ring-shaped body portion that surrounds an outer circumferential surface of a core piece in a circumferential direction thereof; and end portion-side protruding portions that keep an interval between the outer circumferential surface of the core piece and an inner circumferential surface of the ring-shaped body portion. The frame plate portion is provided with: a through hole from which an end surface of an inner core piece included in the magnetic core is exposed, the inner core piece being located inside the winding portion; and a portion that is interposed between the inner core piece and the outer core piece, and forms a predetermined gap between the inner core piece and the outer core piece. The resin mold portion includes: a resin gap portion that is located between the core pieces that are adjacent to each other and constitutes at least another one of the gap portions; an intermediate covering portion that is continuous with the resin gap portion and fills a level difference between an exposed portion of the outer circumferential surfaces of the core pieces that are adjacent to each other and the body portion, the exposed portion being exposed from the cutout portion; an end portion covering portion that is continuous with the intermediate covering portion and is interposed between the outer circumferential surface of the core piece and the inner circumferential surface of the ring-shaped body portion; and a resin gap portion that is located between the inner core piece and the outer core piece.

DETAILED DESCRIPTION OF EMBODIMENTS

Figure 1:
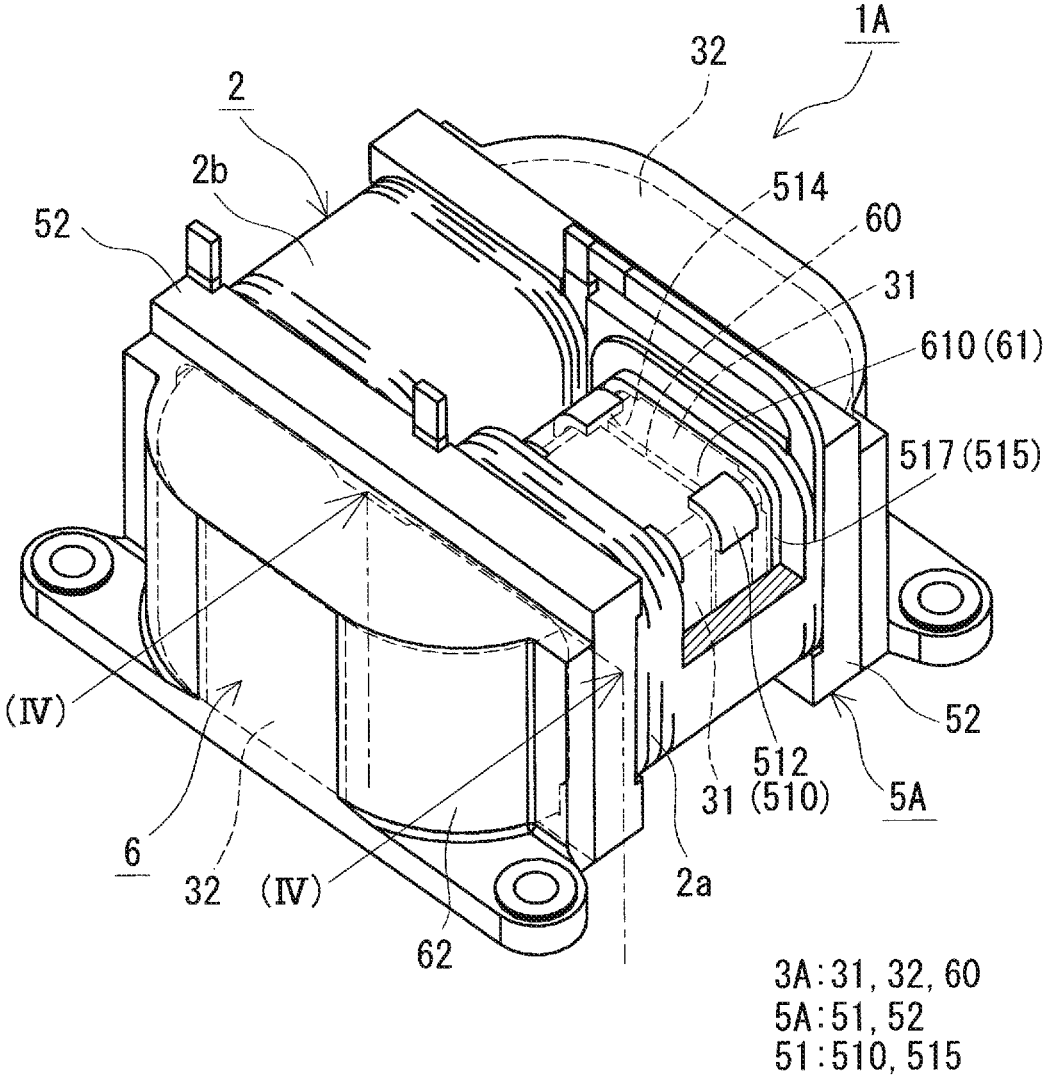
FIG. 1 is a schematic perspective view showing a reactor according to a first embodiment.

As a reactor that includes a plurality of core pieces and a magnetic core that includes at least one magnetic gap between the core pieces, there is demand for a reactor that can keep the interval between the core pieces despite a simple configuration, and achieve excellent productivity.

With a configuration in which the above-described gap plate is provided as a magnetic gap, it is possible to use the gap plate to keep the interval between the core pieces. However, if the core pieces and the gap plate are joined using an adhesive or the like, the number of manufacturing steps increases. Also, as with the conventional tubular bobbins, if the entire circumference surfaces of the above-described stacked objects are covered by the tubular bobbins when the above-described combined body is covered with resin, gaps between the winding portions of the coil and the core pieces in the winding portions are closed by the above-described conventional bobbins, and distribution paths of resin in a flowable state are likely to be narrow. Therefore, the time required for filling with resin increases. From these viewpoints, there is demand for an improvement in productivity.

Thus, an exemplary aspect of the disclosure provides a reactor that can keep the interval between the core pieces despite a simple configuration, and achieve excellent productivity.

Advantageous Effects of Present Disclosure

The above-described reactor can keep the interval between the core pieces despite a simple configuration, and achieve excellent productivity.

Descriptions of Embodiments of Present Disclosure

First, the following lists up and describes embodiments of the present disclosure.

(1) A reactor according to one aspect of the present disclosure includes:

a coil that includes a winding portion;

a magnetic core that includes a plurality of core pieces that are located inside and outside the winding portion, and one or more gap portions that are interposed between core pieces that are adjacent to each other; and an interposed member that is interposed between the coil and the magnetic core.

The interposed member includes a plurality of inner divisional pieces that are interposed between an inner circumferential surface of the winding portion and an outer circumferential surface of the magnetic core, and are located so as to be separated from each other in an axial direction of the winding portion, and at least one inner divisional piece from among the plurality of inner divisional pieces is provided with interposed protruding portions that keep an interval between core pieces that are adjacent to each other, and form at least one of the gap portions.

The above-described reactor includes an inner divisional piece that is provided with interposed protruding portions, and can keep the interval between core pieces that are adjacent to each other, using the interposed protruding portions. Also, a gap portion that corresponds to the size of the interval is provided. Therefore, it is unnecessary to provide a gap plate that is independent of the core pieces, and in the manufacturing process, the step of joining the core pieces and the gap plate can be omitted. Also, the inner divisional piece can be attached to the core pieces such that the interposed protruding portions are located between the core pieces, despite the direction of division being different from that of the conventional tubular bobbins, and thus have a simple configuration and can be easily assembled. The above-described reactor can be manufactured by performing work that is similar to work that is performed to assemble a reactor that is provided with conventional tubular bobbins. Therefore, the above-described reactor can keep the interval between the core pieces despite a simple configuration, and achieve excellent productivity.

The above-described reactor can be used without change. In this case, the gap portions interposed between the core pieces that are adjacent to each other include an air gap and the interposed protruding portions. Alternatively, the above-described reactor may be embodied so as to include a covering member that covers at least a portion of a combined body that includes the coil, the magnetic core, and the interposed member, and includes resin (e.g. the resin mold portion described below). In this embodiment, in the manufacturing process, by filling a mold that houses the combined body or a case that houses the combined body with resin that is in a flowable state (hereinafter also referred to as unsolidified resin), it is possible to fill the gaps formed between the core pieces due to the presence of the interposed protruding portions at the same time, and resin gap portions that are constituted by portions of the covering member can be provided between the core pieces. This embodiment includes the resin gap portions and the interposed protruding portions as the gap portions interposed between the core pieces that are adjacent to each other. Also, since the plurality of inner divisional pieces are arranged so as to be separated from each other in the axial direction of the winding portion of the coil, a portion of the outer circumferential surfaces of the core pieces is exposed from a gap between the inner divisional pieces at a point in time before filling with unsolidified resin, and there is a level difference between the exposed portion and the inner divisional pieces. In the manufacturing process, this level difference can be used as a flow path for injecting unsolidified resin (hereinafter also referred to as the resin flow path), and excellent distribution of unsolidified resin can be achieved. Therefore, the above-described reactor, particularly with the covering member, can form the above-described resin gap portions and cover the combined body at the same time, and achieves excellent distribution of unsolidified resin, and thus achieves excellent productivity.

The resin gap portions interposed between the core pieces also serve as joining members that join the core pieces to each other. Also, the portions exposed from the inner divisional pieces included in the core pieces contribute to an increase in the contact area that is in contact with the above-described covering member. Therefore, in the above-described reactor provided with the covering member, the core pieces are firmly integrated with each other into one piece, and mechanical properties are excellent. Furthermore, the rigidity of the integrated one piece is improved, and vibrations, noise, and so on can be prevented from occurring. In addition, due to the covering member being provided, it can be expected that the reactor will be protected from external factors (corrosion protection for core pieces, for example), insulation regarding the coil and external components will be improved, and, depending on the constituent material of the covering member, heat dissipation properties will be improved, for example.

(2) In another aspect of the above-described reactor, for example, a resin mold portion that includes a resin gap portion that is located between the core pieces that are adjacent to each other and constitutes at least another one of the gap portions, and covers an exposed portion of outer circumferential surfaces of the core pieces that are adjacent to each other, the exposed portion being continuous with the resin gap portion and being exposed from the inner divisional pieces.

According to the above-described aspect, the above-described resin flow path is provided at a point in time before the resin mold portion is formed, and thus excellent distribution of unsolidified resin can be achieved, and the resin gap portion and the portion covering the exposed portion from the inner divisional pieces included in the core pieces can be formed at the same time. Therefore, productivity is excellent. Also, according to the above-described aspect, due to the portion of the resin mold portion covering the above-described exposed portion, it can be expected that the fixing strength of the magnetic core will be improved as described above, and thus mechanical properties will be improved, the core pieces will be protected from external factors, vibrations and noise will be prevented from occurring, insulation between the winding portion of the coil and the core pieces will be improved, and heat dissipation properties will be improved, for example. Furthermore, according to the above-described aspect provided with the resin gap portion, the interval between the core pieces can be more reliably kept compared to cases in which an air gap is provided. Therefore, according to the above-described aspect, inductance is prevented from fluctuating due to variations in the interval between the core pieces, and thus it is possible to keep a predetermined inductance over a long time, and improve reliability. In examples of the aspect (2) and the aspect (3) described below, the outer circumferential surface of the coil may be exposed from the resin mold portion.

(3) In another aspect of the above-described reactor, for example, at least one inner divisional piece from among the plurality of inner divisional pieces includes: the interposed protruding portions; a body portion that continuously covers portions of the outer circumferential surfaces of the core pieces that are adjacent to each other, the interposed protruding portions standing upright on an inner circumferential surface of the body portion; and a cutout portion from which the outer circumferential surfaces are partially exposed so that the body portion is disconnected in a circumferential direction of the outer circumferential surfaces, and the reactor further includes a resin mold portion that includes: a resin gap portion that is located between the core pieces that are adjacent to each other and constitutes at least another one of the gap portions; and an intermediate covering portion that is continuous with the resin gap portion and fills a level difference between an exposed portion of the outer circumferential surfaces and the body portion, the exposed portion being exposed from the cutout portion.

According to the above-described aspect, the exposed portion of the core pieces, which are exposed from the cutout portion, can also be used as a resin flow path before the resin mold portion is formed. Therefore, according to the above-described aspect, in the manufacturing process, resin flow paths can be satisfactorily provided and unsolidified resin can be easily injected into the gaps between the core pieces, and the resin gap portion and the intermediate covering portion can be formed at the same time. Thus, productivity is excellent.

The above-described aspect achieves the same effects as the above-described aspect (2), i.e. inductance is maintained due to the resin gap portion being provided, and mechanical properties are improved, protection from external factors is achieved, vibrations and noise are prevented from occurring, insulation is improved, and heat dissipation properties are improved due to the resin gap portions and the intermediate covering portion being provided, for example.

Furthermore, according to the above-described aspect, if the gap formed by the interposed protruding portions between the core pieces that are adjacent to each other is seen in the circumferential direction of the core pieces at a time in point before the resin mold portion is formed, a portion of the gap is exposed from the cutout portion and is open, and the remaining portion is covered by the body portion. By using the opening exposed from the cutout portion as an unsolidified resin injection port, it is possible to restrict the direction in which unsolidified resin is injected to the gap between the core pieces. Here, if unsolidified resin is injected into a narrow space like the gap between core pieces in many directions, portions of unsolidified resin hit each other in the narrow space, for example, and there is the possibility of unsolidified resin not being appropriately filled into the gap between core pieces. According to the above-described aspect, in the manufacturing process, the direction in which unsolidified resin is injected into the gap between the core pieces is restricted by the cutout portion, and the resin gap portion can be appropriately formed. Thus, a predetermined inductance can be maintained.

(4) In another aspect of the reactor according to (3) above provided with the resin mold portion, the plurality of inner divisional pieces include: at least one intermediate divisional piece that is located at an intermediate position in an axial direction of the winding portion, and is provided with the interposed protruding portions; and a pair of end portion divisional pieces that sandwich the intermediate divisional piece and are located at end surface sides of the winding portion, the end portion divisional pieces are each provided with: a ring-shaped body portion that surrounds an outer circumferential surface of a core piece in a circumferential direction thereof; and end portion-side protruding portions that keep an interval between the outer circumferential surface of the core piece and an inner circumferential surface of the ring-shaped body portion, and the resin mold portion includes an end portion covering portion that is continuous with the intermediate covering portion and is interposed between the outer circumferential surface of the core piece and the inner circumferential surface of the ring-shaped body portion.

According to the above-described aspect, in addition to the effects described in the above-described aspect (3) being achieved, the gap formed by the end portion-side protruding portions between the ring-shaped body portion and the core pieces can also be used as resin flow path at a point in time before the resin mold portion is formed. Therefore, according to the above-described aspect, in the manufacturing process, resin flow paths can be satisfactorily provided, and distribution of unsolidified resin is excellent. Thus, productivity is excellent.

(5) In another aspect of the reactor according to any one of (2) to (4) above provided with the resin mold portion, an outer circumferential surface of at least one of the core pieces to which the inner divisional pieces are attached has a shape with corners, the plurality of inner divisional pieces include: at least one intermediate divisional piece that is located at an intermediate position in an axial direction of the winding portion, and is provided with the interposed protruding portions; and a pair of end portion divisional pieces that sandwich the intermediate divisional piece and are located at end surface sides of the winding portion, and the end portion divisional pieces are each provided with: a ring-shaped body portion that surrounds the outer circumferential surface of the core piece with the corners in the circumferential direction thereof; and end portion claw portions that protrude from the ring-shaped body portion so as to cover the corners of the core piece.

According to the above-described aspect, the corners of the core pieces are locally covered by the end portion claw portions, and therefore, resin flow paths can be secured in the manufacturing process, and thus unsolidified resin can be desirably distributed and excellent productivity can be achieved. In addition, it is possible to prevent unsolidified resin injected from the end surface side of the winding portion of the coil from flowing back toward the injection side via the end surface of the coil and covering the outer circumferential surface of the coil. According to the above-described aspect, the outer circumferential surface of the coil is typically exposed without being covered by the resin mold portion.

The above-described aspect is based on the following findings. If the end portion claw portions are not provided, a relatively large gap is formed at a position that is between an end portion divisional piece and an intermediate divisional piece, and between the corners of the core pieces and the inner circumferential surface of the winding portion of the coil. If unsolidified resin injected from the end surface side of the winding portion reaches the above-described large gap via the end portion divisional piece, unsolidified resin may flow back toward the end surface of the winding portion via a small gap that is in communication with the large gap and is formed between the outer circumferential surface of the end portion divisional piece and the inner circumferential surface of the winding portion. Although it depends on the filling conditions of unsolidified resin, the material of unsolidified resin, the shape and size of each core piece, the size of the above-described gap, and so on, it is possible to prevent unsolidified resin, which flows backward, from leaking out of the end surface of the coil and covering the outer circumferential surface of the coil, by increasing the distance from the above-described large gap to the outer circumferential surface of the coil via the end surface of the coil. Also, if a configuration in which the corners of the core pieces are locally covered is employed instead of a configuration in which the entire outer circumferential surfaces of the core pieces are covered by the inner divisional piece, resin flow paths can be satisfactorily secured and excellent productivity can be achieved. Based on these findings, the above-described aspect has a configuration in which the end portion claw portions are provided.

(6) In another aspect of the reactor according to any one of (2) to (5) above provided with the resin mold portion, an outer circumferential surface of at least one of the core pieces to which the inner divisional pieces are attached has a shape with corners, the plurality of inner divisional pieces include at least one intermediate divisional piece that is located at an intermediate position in an axial direction of the winding portion and is provided with the interposed protruding portions, and the intermediate divisional piece includes: a body portion that continuously covers portions of the outer circumferential surfaces of the core pieces that are adjacent to each other; a cutout portion from which the outer circumferential surfaces are partially exposed so that the body portion is disconnected in a circumferential direction of the outer circumferential surfaces; and intermediate claw portions that protrude from the body portion so as to cover the corners of the core piece.

According to the above-described aspect, the corners of the core pieces are locally covered by the intermediate claw portions, and therefore, resin flow paths can be secured in the manufacturing process, and thus unsolidified resin can be desirably distributed and excellent productivity can be achieved. In addition, it is possible to prevent cracks from occurring in the resin mold portion when the reactor is used.

The above-described aspect is based on the following findings. If the corners of the core pieces are not covered by the intermediate claw portions and the corners of the core pieces come into direct contact with unsolidified resin, areas where the resin mold portion covers the corners of the core pieces are likely to be stress concentration areas. When the reactor is used, if thermal stress or external stress is applied to the resin mold portion that locally has stress concentration areas, there are cases in which a crack occurs in the resin mold portion, from a stress concentration area. If the corners of the core pieces are covered such that unsolidified resin does not come into direct contact therewith, it is possible to reduce, or preferably, substantially eliminate the above-described stress concentration areas. Also, if a configuration in which the corners of the core pieces are locally covered is employed instead of a configuration in which the entire outer circumferential surfaces of the core pieces are covered by the inner divisional piece, resin flow paths can be satisfactorily secured and excellent productivity can be achieved. Based on these findings, the above-described aspect has a configuration in which the intermediate claw portions are provided. To more reliably prevent stress concentration areas from occurring, it is preferable that the entire length, in the axial direction of the winding portion of the coil, of the corners of the core pieces are covered by the intermediate claw portions, or the corners are covered by both the intermediate claw portions and the above-described end portion claw portions.

(7) In another aspect of the reactor according to any one of (2) to (5) above provided with the resin mold portion, an outer circumferential surface of at least one of the core pieces to which the inner divisional pieces are attached has a shape with corners, the plurality of inner divisional pieces include at least one intermediate divisional piece that is located at an intermediate position in an axial direction of the winding portion and is provided with the interposed protruding portions, and the intermediate divisional piece is provided with: the interposed protruding portions that each have a plate shape that does not protrude from the outer circumferential surfaces of the core pieces that are adjacent to each other; and intermediate claw portions that protrude from corners of the interposed protruding portions so as to cover the corners of the core piece.

According to the above-described aspect, the corners of the core pieces are locally covered by the intermediate claw portions, and the interposed protruding portions do not protrude from the outer circumferential surfaces of the core pieces. Therefore, larger portions of the outer circumferential surfaces of the core pieces that are adjacent to each other can be exposed from the intermediate divisional pieces, and larger resin flow paths can be easily secured in the manufacturing process. Therefore, according to the above-described aspect, the flowability of unsolidified resin is excellent and the resin mold portion can be easily formed, and thus excellent productivity can be achieved. Also, according to the above-described aspect, it is easier to secure large contact areas between the core pieces and the resin mold portion, and it is possible to increase the fixing strength of the resin mold portion fixing the magnetic core.

(8) In another aspect of the reactor according to (6) or (7) above provided with the intermediate claw portions, the intermediate claw portions are provided with engagement portions that engage with other claw portions that are adjacent thereto.

According to the above-described aspect, intermediate claw portions that are adjacent to each other, or an intermediate claw portion and the above-described end portion claw portion can be engaged with each other using the engagement portions. Therefore, it is easy to position a plurality of independent inner divisional pieces relative to each other, and to maintain a state in which the inner divisional pieces are attached to the core pieces. Thus, productivity is excellent.

Details of Embodiments of Present Disclosure

The following specifically describes embodiments of the present disclosure with reference to the drawings. The same reference numerals in the drawings refer to components with the same name.

First Embodiment

The following describes a reactor 1A according to a first embodiment with reference to FIGS. 1 to 4.

Figure 4:
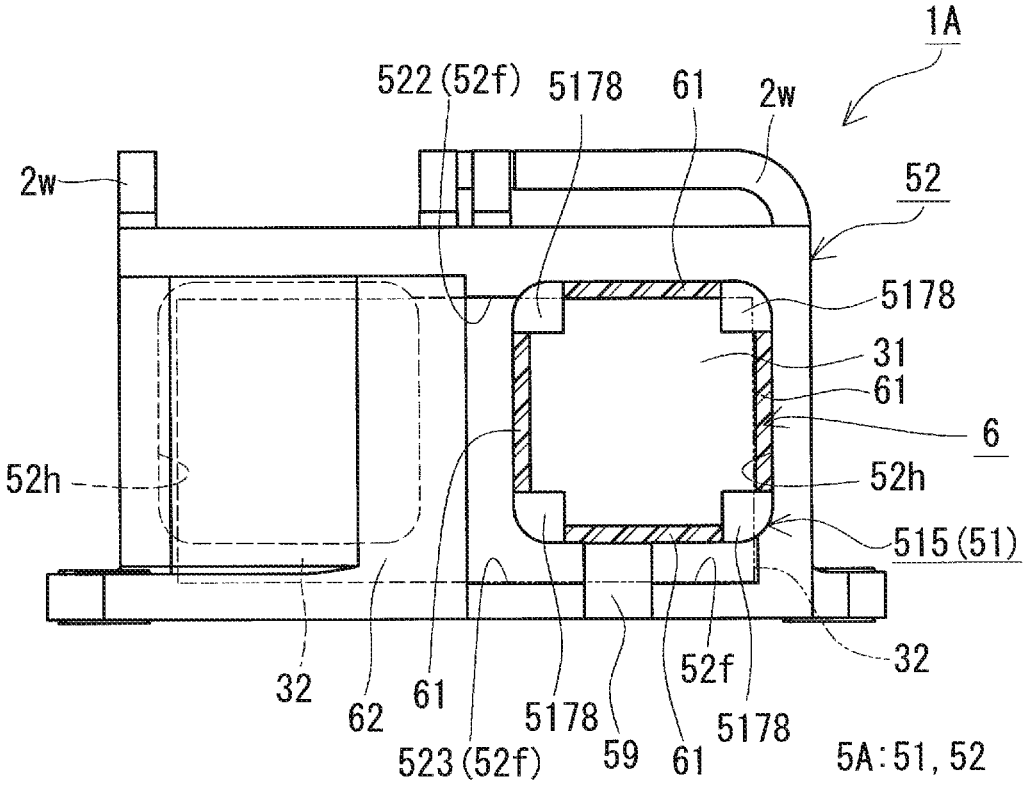
FIG. 4 is a front view of the reactor according to the first embodiment seen in an axial direction of a coil from an outer core piece side, only showing the left half of the outer core piece.

In FIG. 1, a winding portion 2*a* is partially cut out so that the inside of a coil 2 can be clearly seen. In FIG. 4, an outer core piece 32 is cut along a cutting line (IV)-(IV) in FIG. 1, the right half of the outer core piece 32 is removed, and the left half thereof is only shown so that an outer core piece side surface of a frame plate portion 52 can be clearly seen.

Reactor

Overall Configuration

As shown in FIG. 1, the reactor 1A according to the first embodiment includes: a coil 2 that includes winding portions 2*a* and 2*b* that are tubular; a magnetic core 3A that is provided inside and outside the winding portions 2*a* and 2*b*; and an interposed member 5A that is interposed between the coil 2 and the magnetic core 3A. The reactor 1A in this example also includes a resin mold portion 6 that covers at least a portion of the outer circumferential surface of the magnetic core 3A. The outer circumferential surface of the coil 2 in this example is exposed without being covered by the resin mold portion 6, and the inner circumferential surfaces of the coil 2 is covered by the constituent resin of the resin mold portion 6 and the interposed member 5A. Typically, the reactor 1A is attached to an installation target (not shown) such as a converter case, and used. FIG. 1 shows an example in which the installation side when the reactor 1A is installed is the lower side and the opposite side is the upper side.

The magnetic core 3A included in the reactor 1A includes a plurality of core pieces and at least one gap portion (a plurality of gap portions in this example) that is interposed between core pieces that are adjacent to each other. In this example, the magnetic core 3A includes a plurality of inner core pieces 31 that are located inside the winding portions 2*a* and 2*b*, a pair of outer core pieces 32 that are located outside the winding portions 2*a* and 2*b*, and gap portions (which include resin gap portions 60 described later, in this example) that are interposed between an inner core piece 31 and an outer core piece 32, and between inner core pieces 31.

The interposed member 5A included in the reactor 1A includes a plurality of inner divisional pieces 51, which are inner interposed portions that are interposed between the inner circumferential surfaces of the winding portions 2*a* and 2*b* and the outer circumferential surface of the magnetic core 3A. The interposed member 5A in this example further includes a pair of frame plate portions 52 that are interposed between end surfaces of the winding portions 2*a* and 2*b* and inner end surfaces 32*e* (FIG. 2) of the outer core pieces 32, and that are independent of the inner interposed portions.

One feature of the reactor 1A according to the first embodiment is that the plurality of inner divisional pieces 51 in the winding portions 2*a* and 2*b* are located so as to be separated from each other in the axial direction of the winding portions 2*a* and 2*b*. In this example, the plurality of inner divisional pieces 51 that are located in the winding portions 2*a* and 2*b* include: a plurality of intermediate divisional pieces 510 that are located at intermediate positions in the axial direction of the winding portion 2*a* or the winding portion 2*b*; and a pair of end portion divisional pieces 515 that sandwich the intermediate divisional pieces 510 and are located on the end surface sides of the winding portion 2*a* or the end surface sides of the winding portion 2*b* (see FIG. 2 also). One feature of the reactor 1A according to the first embodiment is that at least one inner divisional piece 51 (a plurality of intermediate divisional pieces 510 in this example) of the plurality of inner divisional pieces 51 is located in the winding portions 2*a* or 2*b*, and that the reactor 1A includes interposed protruding portions 5126 (FIG. 2) that each keep the interval between core pieces that are adjacent to each other (inner core pieces 31 in this example) and form some of the above-described gap portions. In this example, resin gap portions 60 that are constituted by portions of the resin mold portion 6 are provided as others of the above-described gap portions. In the reactor 1A, the interposed member 5A keeps the interval between core pieces that are adjacent to each other, and is provided with gap portions that corresponding to the magnitude of the interval. Therefore, the reactor 1A does not need, for example, a gap plate that is made of alumina, and has a simple configuration.

The following describes overviews of the coil 2 and the magnetic core 3A, which are main members of the reactor 1A, and then describes the details of the interposed member 5A, which is one feature, and details of the resin mold portion 6.

Coil

Figure 2:
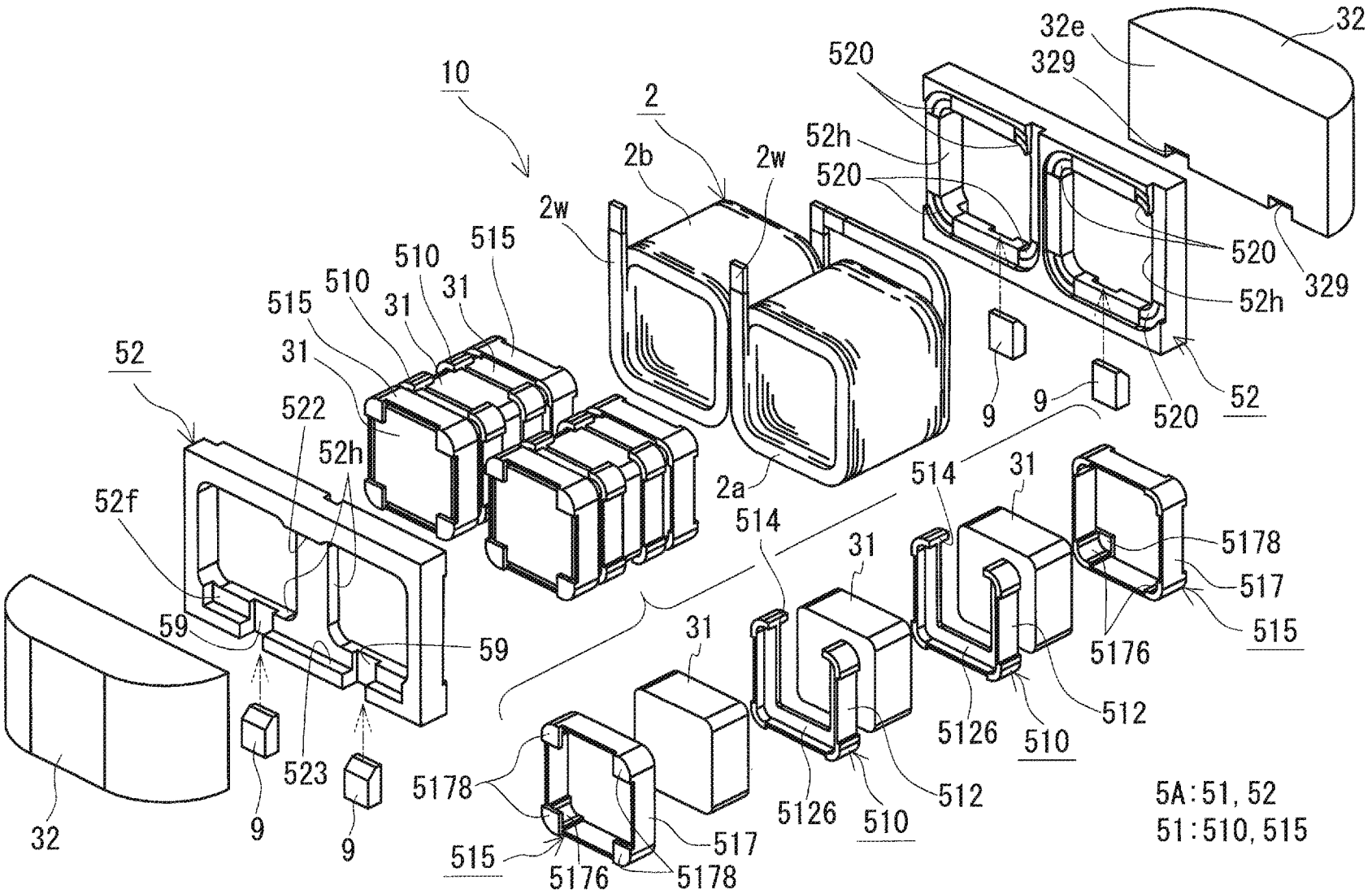
FIG. 2 is an exploded perspective view of a combined body that is included in the reactor according to the first embodiment.

The coil 2 in this example is formed by joining and integrating individual winding portions 2*a* and 2*b* into one piece as shown in FIG. 2. Specifically, each of the winding portions 2*a* and 2*b* has a tubular shape formed by spirally winding one continuous winding wire 2*w*, and the winding portions 2*a* and 2*b* are arranged in parallel (side by side) such that the axes thereof extend in parallel with each other. End portions of the winding wires 2*w* are joined to each other through welding, crimping or the like so that a joining point is formed, and as a result of such joining, the coil 2 constitutes an integrated member that is electrically connected. FIG. 2 shows an example in which one end portion of the winding wire 2*w* that forms the one winding portion 2*b* is drawn out upward away from the winding portion 2*b*, and one end portion of the winding wire 2*w* that forms the other winding portion 2*a* is bent toward the one winding portion 2*b*, and thus both end portions are brought close to each other. The other end portions of the winding wires 2*w* extend from the winding portions 2*a* and 2*b* in appropriate directions, and to which, typically, terminal members (not shown) are connected. Although FIG. 2 shows that the other end portions are drawn out upward away from the winding portions 2*a* and 2*b*, directions in which the other end portions are drawn out may be changed as appropriate. An external device such as a power supply that supplies power to the coil 2 is connected via the above-described terminal members.

The end surfaces of the winding portions 2*a* and 2*b* in this example each have a square shape with rounded corners. Also, each winding wire 2*w* in this example is a coated flat wire (a so-called enameled wire) that includes: a conductor (copper or the like), which is a flat wire; and an insulative coating (polyamide or the like) that covers the outer circumferential surface of the conductor, and the winding portions 2*a* and 2*b* are edgewise coils.

Magnetic Core

Figure 3A:
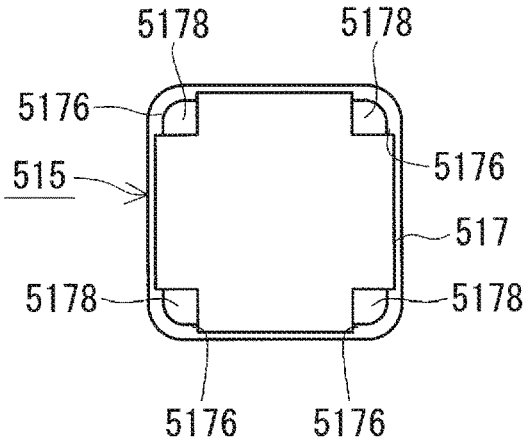
FIG. 3A is a front view of an inner divisional piece of an interposed member that is included in the reactor according to the first embodiment, in which an end portion divisional piece is seen in a direction in which an inner core piece is fitted.

As described above, the magnetic core 3A includes a plurality of inner core pieces 31, a pair of outer core pieces 32, and a plurality of gap portions (resin gap portions 60). The shape of the outer circumferential surface (the contour that is formed by surfaces that are substantially parallel with the axis of the coil 2) of each inner core piece 31 in this example is a shape that has corners. As shown in FIGS. 2, 3D, and 3E, the inner core pieces 31 are columnar members whose end surfaces each have a square shape with rounded corners, corresponding to the shape of the winding portions 2*a* and 2*b*. Each of the outer core pieces 32 shown in FIG. 2 is a columnar member whose installation surface (lower surface) and opposite surface (upper surface) are dome-shaped. The inner end surface 32*e*, which serves as a surface for connection with an end surface of an inner core piece 31, of each outer core piece 32 is constituted by a uniform flat surface, except for cutouts 329 described below. The pair of outer core pieces 32 are attached so as to connect the pair of stacked portions in each of which the plurality of inner core pieces 31 and the resin gap portions 60 are alternatingly arranged, and thus a magnetic core 3A that is ring-shaped is formed. The magnetic core 3A forms a closed magnetic circuit when the coil 2 is excited.

The inner core pieces 31 and the outer core pieces 32 are mainly made of a soft magnetic material. Examples of a soft magnetic material include iron and an iron alloy (an Fe—Si alloy, an Fe—Ni alloy, or the like). The inner core pieces 31 and the outer core pieces 32 are, for example, powder compacts formed by compression-molding powder that is made of a soft magnetic metal material or coated powder that is composed of particles with insulative coatings, or molded members that are made of composite materials including soft magnetic powder and resin. The details of the resin gap portions 60 will be described in the section regarding the resin mold portion 6.

Interposed Member

The following describes the interposed member 5A mainly with reference to FIGS. 2 to 4.

Overview

The interposed member 5A is typically made of an insulative material, and serves as an insulation member between the coil 2 and the magnetic core 3A. Also, the interposed member 5A is formed so as to have predetermined dimensions and a predetermined shape as described below, and serves as a positioning member that positions the inner core pieces 31 and the outer core pieces 32 relative to the winding portions 2*a* and 2*b*. In this example, the plurality of inner divisional pieces 51 insulate the inner circumferential surfaces of the winding portions 2*a* and 2*b* and the inner core pieces 31 from each other, and position the inner core pieces 31 relative to the winding portions 2*a* and 2*b*. The frame plate portions 52 insulate the end surfaces of the winding portions 2*a* and 2*b* and the outer core pieces 32 from each other, and position the outer core pieces 32 relative to the winding portions 2*a* and 2*b*. As a result, the interposed member 5A positions the inner core pieces 31 and the outer core pieces 32.

In the reactor 1A according to the first embodiment, the interposed member 5A includes the interposed protruding portions 5126 that keep the interval between core pieces (inner core pieces 31 in this example) to which the intermediate divisional pieces 510, from among the plurality of inner divisional pieces 51, are adjacent, and also serves as a gap forming member. The reactor 1A in this example includes, as gap portions that are located between inner core pieces 31 that are adjacent to each other, resin gap portions 60 that are constituted by portions of the resin mold portion 6.

In the reactor 1A in this example, a plurality of (two in this example) intermediate divisional pieces 510 and a pair of end portion divisional pieces 515 are provided for the plurality of (three in this example) inner core pieces 31 that are arranged in parallel, at predetermined intervals in the axial direction of the winding portions 2*a* and 2*b*. Thus, before the resin mold portion 6 is formed, spaces (step-like spaces between the outer circumferential surfaces of the inner core pieces 31 and the inner divisional piece 51) that correspond to the dimensions of the above-described intervals are provided around the outer circumferential surfaces of the inner core pieces 31 (see the assembly of the set of inner core pieces 31 and the inner divisional piece 51 in FIG. 2, and FIG. 3C). The intermediate divisional pieces 510 in this example do not cover the entire circumferences of the inner core pieces 31, and are cut out such that a portion of each inner core piece 31 in the circumferential direction is exposed to the outside. Therefore, before the resin mold portion 6 is formed, spaces (step-like spaces between the inner core pieces 31 and intermediate divisional pieces 510) corresponding to the cut outs are provided around the outer circumferential surfaces of the inner core pieces 31 (see a gap $G_{514}$ in FIG. 3E). Although the end portion divisional pieces 515 in this example are ring-shaped members that each surround the entire circumference of an inner core piece 31, the end portion divisional pieces 515 have a shape that secures a predetermined interval between each end portion divisional piece 515 and the outer circumferential surface of an inner core piece 31. Therefore, before the resin mold portion 6 is formed, spaces that correspond to the dimensions of the above-described intervals are provided between the end portion divisional pieces 515 and the outer circumferential surfaces of the inner core pieces 31 (see gaps g in FIG. 3D). These spaces can be used as resin flow paths of unsolidified resin when the resin mold portion 6 is formed. Therefore, the interposed member 5A also serves as a member for forming resin flow paths of unsolidified resin.

Each intermediate divisional piece 510 has the same shape. Also, each end portion divisional piece 515 has the same shape. The following description only illustrates one intermediate divisional pieces 510 and one end portion divisional piece 515.

Inner Divisional Pieces

Intermediate Divisional Piece

Figure 3B:
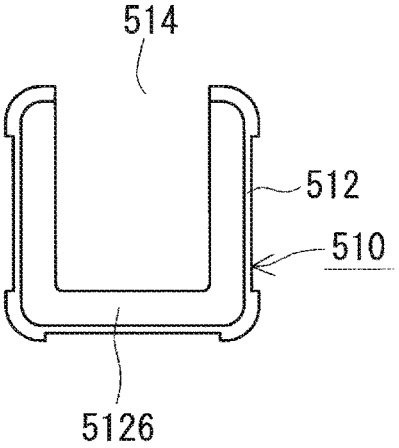
FIG. 3B is a front view of an intermediate divisional piece, showing an inner divisional piece of an interposed member that is included in the reactor according to the first embodiment.
Figure 3C:
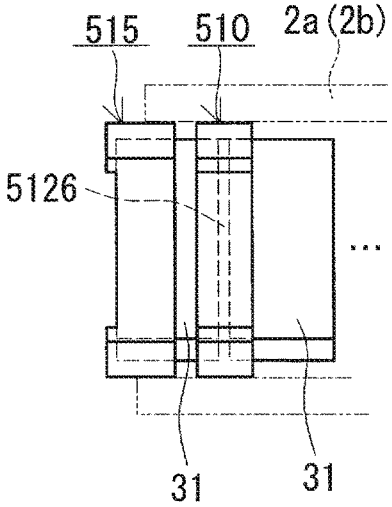
FIG. 3C is a side view of an inner divisional piece of the interposed member that is included in the reactor according to the first embodiment, showing a state in which an end portion divisional piece and an intermediate divisional piece are attached to inner core pieces that are adjacent to each other.
Figure 3D:
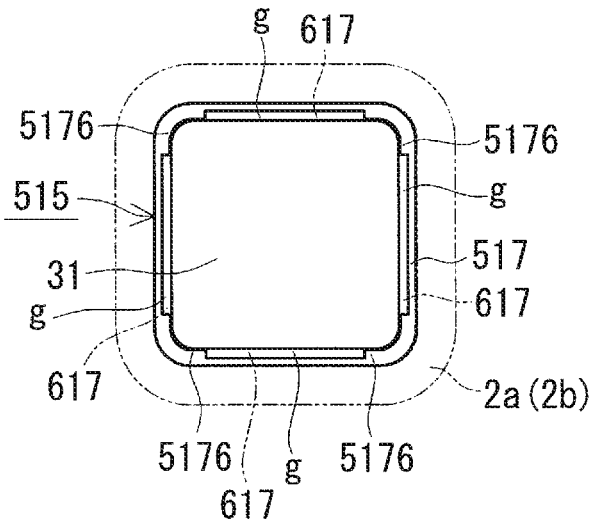
FIG. 3D is a front view of an inner divisional piece of the interposed member that is included in the reactor according to the first embodiment, showing a state in which an inner core piece is attached to the end portion divisional piece in FIG. 3A.
Figure 3E:
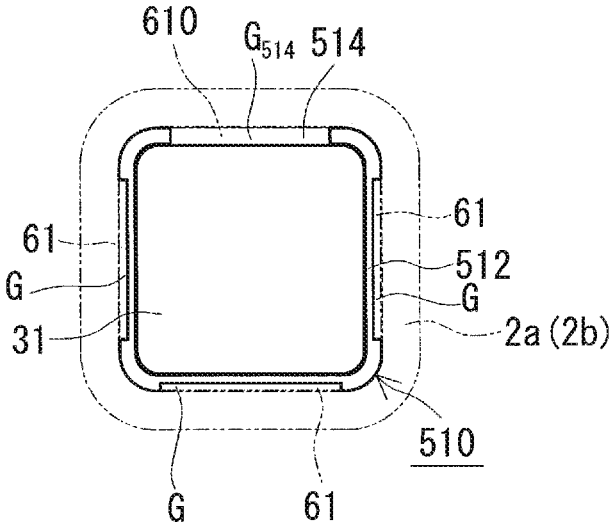
FIG. 3E is a front view of an inner divisional piece of the interposed member that is included in the reactor according to the first embodiment, showing a state in which an inner core piece is attached to the intermediate divisional piece in FIG. 3B.

As shown in FIGS. 2, 3B, and 3E, the intermediate divisional piece 510 in this example is a member formed by bending a band-like member so as to have a U-shape extending along the outer circumferential surface of an inner core piece 31. In a state where an inner core piece 31 and an intermediate divisional piece 510 are assembled, the inner circumferential surface of the intermediate divisional piece 510 is substantially in contact with the inner core piece 31 (FIG. 3E, a small gap that may occur in assembly work is acceptable), and serves as a supporting surface (see FIG. 3C also).

Specifically, the intermediate divisional piece 510 includes: a body portion 512 that continuously covers a portion of the outer circumferential surfaces of inner core pieces 31 that are adjacent to each other; and a cutout portion 514 from which the above-described portions of the outer circumferential surfaces are exposed so that the body portion 512 is disconnected in the circumferential direction. The body portion 512 in this example is a frame member whose end surface has a square shape with rounded corners, which corresponds to the inner core pieces 31 whose end surfaces have a square shape with rounded corners (FIGS. 3B and 3E). The inner circumferential surface of the body portion 512 is constituted by a smooth surface that extends along the inner core piece 31, and the outer circumferential surface of the same is provided with a thick wall portion and thus has a shape with recesses and protrusions. FIG. 3E shows an example of the body portion 512 that covers three surfaces (the left and right surfaces, and the lower surface), and the four rounded corners of the inner core piece 31, and does not cover one surface (the upper surface) of the inner core piece 31 so that the one surface is exposed to the outside. Note that the intermediate divisional piece 510 in this example has a rotationally symmetrical shape that remains the same when rotated from the state shown in FIG. 3B by 180° in the horizontal direction.

The circumferential length of the area of the body portion 512 that covers the outer circumferential surfaces of the inner core pieces 31 can be selected as appropriate. The shorter this circumferential length is (e.g. a configuration that includes a lower surface and two corners that are continuous with the lower surface (see a fourth embodiment described below)), the longer the circumferential length of the cutout portion 514 is. As a result, the portions of the outer circumferential surfaces of the inner core pieces 31 exposed from the body portion 512 increase, and the above-described resin flow path increases. The longer the circumferential length of the above-described area is, the shorter the circumferential length of the cutout portion 514 is. As a result, areas of the inner core pieces 31 supported by the body portion 512 increase, and the inner core pieces 31 and the intermediate divisional piece 510 are likely to be stable in an assembled state in the manufacturing process. If only one surface (the upper surface) of each inner core piece 31 is exposed to the outside as in this example, when the resin mold portion 6 is formed, unsolidified resin can be injected into a gap between core pieces from only an opening on the one surface side exposed from the cutout portion 514. That is, unsolidified resin can be injected in one direction. For example, if unsolidified resin is injected into the above-described gap between core pieces from two directions, there is the possibility of a weld line being formed at the position where unsolidified resin from two directions comes into contact. If a configuration in which unsolidified resin is injected into the above-described gap between core pieces in one direction is employed, the above-described weld line is unlikely to be formed, and substantially no degradation in performance is caused by a weld line.

To inject unsolidified resin in one direction, it is possible to select the circumferential length of the body portion 512 according to the shape of the interposed protruding portion 5126, for example. Even if the circumferential length of the body portion 512 is short, it is possible to inject unsolidified resin in one direction by providing a U-shaped interposed protruding portion 5126 as shown in FIG. 3B, for example, so that only portions, in the circumferential direction, of the inner core piece 31 that are adjacent to each other are open. As in this example, if the interposed protruding portion 5126 is U-shaped and the cutout portion 514 is provided so as to be continuous with the opening, and in addition, if three surfaces of each inner core piece 31 are covered by the body portion 512, it is easier to regulate the direction in which unsolidified resin is injected.

The thickness of the body portion 512 can be selected as appropriate, considering, for example, insulation required between the winding portions 2*a* and 2*b* and the magnetic core 3A. For example, the thickness of the body portion 512 may be uniform along the entire length of the body portion 512. Alternatively, as in this example, the thickness of the body portion 512 may be partially varied. Specifically, as shown in FIG. 3B, the thickness of the corners and the vicinity thereof is larger than the thickness of other portions. Since the body portion 512 includes a thick wall portion and a thin wall portion that has a small thickness, and thus has a shape with recesses and protrusions, a step-like space G (FIG. 3E) between these portions can be used as a resin path of the resin mold portion 6. The outer circumferential surface of the thin wall portion of the body portion 512 is covered by the resin mold portion 6 (the inner covering portions 61) as indicated by the cutout portion of the coil 2 in FIG. 1 and the two-dot chain line (an imaginary line) in FIG. 3E. Typically, the outer circumferential surface of the thick wall portion of the body portion 512 is exposed from the resin mold portion 6 (FIG. 1), and is located near, or is in contact with, the inner circumferential surfaces of the winding portions 2*a* and 2*b* (FIG. 3E). The larger the proportion of the thin wall portion in the body portion 512 is (e.g. when only two corners at diagonal positions are thick wall portions), the larger the size of the resin flow path is, and as a result, the contact area between the body portion 512 and the resin mold portion 6 increases. Therefore, although the magnetic core 3A includes a plurality of core pieces and the interposed member 5A includes a plurality of divisional pieces, it is possible to increase the fixing strength of the resin mold portion 6 fixing the magnetic core 3A. The larger the proportion of the thick wall portion in the body portion 512 is (e.g. when a portion that covers the entirety of at least one of the three surfaces of the inner core piece 31 is the thick wall portion), the easier it is to increase the insulation between the coil 2 and the magnetic core 3A is.

The length (hereinafter referred to as "the width") of the body portion 512 in the axial direction of the winding portions 2*a* and 2*b* can be selected as appropriate. The width of the body portion 512 in this example is uniform along the entire circumference thereof (FIG. 2). The longer the width of the body portion 512 is, the larger the areas of the inner core pieces 31 supported by the body portion 512 are, and as described above, the assembled state is likely to be stable in the manufacturing process. Also, the length of the body portion 512 covering the corners of the inner core pieces 31 increases, and cracks are more likely to be prevented from occurring in the resin mold portion 6. The shorter the width of the body portion 512 is, the longer the interval between intermediate divisional pieces 510 that are adjacent to each other is, the longer the interval between an intermediate divisional piece 510 and an end portion divisional piece 515 that are adjacent to each other is, and the larger the above-described resin flow path is. As a result, it is possible to increase the contact areas between the inner core pieces 31 and the resin mold portion 6, and to increase the fixing strength of the resin mold portion 6 fixing the magnetic core 3A. The width of the body portion 512 may be partially varied (for a similar configuration, see second and third embodiments). Also, regarding the width of a ring-shaped body portion 517 of the end portion divisional piece 515 described below, see the description regarding the width of the body portion 512. The width of the body portion 512 and the width of the ring-shaped body portion 517 described below may be set such that the interval between the intermediate divisional pieces 510 and the interval between the intermediate divisional piece 510 and the end portion divisional piece 515 described above are predetermined values.

Interposed Protruding Portion

The intermediate divisional piece 510 includes, in addition to the body portion 512 that is interposed between the inner circumferential surfaces of the winding portions 2*a* and 2*b* of the coil 2 and the outer circumferential surface of the magnetic core 3A, the interposed protruding portion 5126 that stands upright from the inner circumferential surface of the body portion 512, i.e. the surface that faces an outer circumferential surface of the inner core piece 31, in an orthogonal direction. As shown in FIG. 3C, the interposed protruding portion 5126 is interposed between inner core pieces 31 that are adjacent to each other, to keep the interval between the inner core pieces 31 at a length that corresponds to the thickness of the interposed protruding portion 5126. The interval between the inner core pieces 31 is used as a magnetic gap. Therefore, the thickness of the interposed protruding portion 5126 is set according to a predetermined magnetic gap length.

As shown in FIG. 3B, the interposed protruding portion 5126 in this example is a U-shaped flat plate member that is provided along the entire length, in the circumferential direction, of the U shape of the inner circumferential surface of the body portion 512 (see FIG. 2 also). The interposed protruding portion 5126 has a square external shape with rounded corners corresponding to the shape of the end surfaces of the inner core pieces 31. The inner edge surface of the U-shaped flat plate member is continuous with the inner circumferential surface that defines the cutout portion 514. The shape and location of the interposed protruding portion 5126 may be changed as appropriate. In this example, as described above, the interposed protruding portion 5126 has a shape that matches the shape of the body portion 512 and is one member that is continuous with the body portion 512. However, it is possible to employ, for example, a configuration in which a plurality of interposed protruding portions are arranged at intervals in the circumferential direction of the inner circumferential surface of the body portion 512, or a configuration that is provided with one interposed protruding portion that is only located on a portion of the inner circumferential surface of the body portion 512 in the circumferential direction. Both configurations are provided with an interposed protruding portion that is a segment-shaped portion whose length in the circumferential direction of the body portion 512 is shorter than the circumferential length of the body portion 512. Alternatively, the interposed protruding portion 5126 may be, for example, a rod-shaped member instead of a flat plate member or a segment, or in addition to the interposed protruding portion that is segment-shaped.

In a state where the inner core piece 31 and the intermediate divisional piece 510 are assembled, the interposed protruding portion 5126 covers an end surface of the inner core piece 31. Therefore, the larger the proportion of the area covered by the interposed protruding portion 5126 relative to the end surface of the inner core piece 31 is, the larger the area of a portion of the end surface of the inner core piece 31 supported by the interposed protruding portion 5126 is. As a result, it is easier to keep the interval between inner core pieces 31. The smaller the proportion of the above-described area is, the larger the contact area, with a resin gap portion 60, of the end surface of the inner core piece 31 is, in this example. Therefore, it can be expected that the bonding strength of the inner core pieces 31 with the resin gap portions 60 will be improved. To improve the bonding strength, the interposed protruding portion 5126 may be downsized, and areas where the resin gap portions 60 are formed may be enlarged. The proportion of the area not covered by the interposed protruding portion 5126 in the inner core piece 31 may be, for example, greater than or equal to 50%, greater than or equal to 60%, greater than or equal to 70%, or, furthermore, greater than or equal to 80%. The shape of the interposed protruding portion 5126, the protruding height of the interposed protruding portion 5126 from the inner circumferential surface of the body portion 512, the total circumferential length in the circumferential direction of the inner circumferential surface of the body portion 512, the arrangement, and so on may be selected such that the proportion of the above-described area is a predetermined value.

The number of intermediate divisional pieces 510 that are arranged in one of the winding portions 2*a* and 2*b* can be changed as appropriate, and may be one or three or more. If a plurality of intermediate divisional pieces 510 are provided, intermediate divisional pieces 510 that are different from each other in shape, dimensions (e.g. the circumferential length, thickness, and width of the body portion 512, the proportion of the area regarding the interposed protruding portion 5126, etc.), and so on may be provided. If all of the intermediate divisional pieces 510 have the same shape and the same dimensions as in this example, handling is easy when assembling them, which leads to excellent productivity of the reactor 1A as well as excellent productivity of the intermediate divisional pieces 510 (the same applies to the end portion divisional pieces 515 described below). The description in this paragraph applies to the second to fourth embodiments described below in the same manner.

End Portion Divisional Piece

As shown in FIGS. 2, 3A, and 3D, the end portion divisional piece 515 in this example is a ring-shaped member as if it was formed by winding a belt member so as to have a square shape with rounded corners, along the outer circumferential surface of the inner core piece 31. In a state where the inner core piece 31 and the end portion divisional piece 515 are assembled, portions (corners in this example) of the inner circumferential surface of the end portion divisional piece 515 are in contact with the inner core piece 31 to support the inner core piece 31, and other portions (portions other than the corners in this example) are not in contact with the inner core piece 31, and gaps g are formed between the end portion divisional piece 515 and the inner core piece 31. Specifically, the end portion divisional piece 515 includes the ring-shaped body portion 517 that surrounds the outer circumferential surface of the inner core piece 31 in the circumferential direction and end portion-side protruding portions 5176 that keep the interval between the outer circumferential surface of the inner core piece 31 and the inner circumferential surface of the ring-shaped body portion 517.

Here, as with the intermediate divisional piece 510, the end portion divisional piece 515 may be provided with the cutout portion 514. However, in this example, substantially, the magnetic core 3A is only covered by the resin mold portion 6, and the coil 2 is not covered by the resin mold portion 6. Therefore, the end portion divisional piece 515 is ring-shaped without being provided with a cutout portion 514. Since the end portion divisional piece 515 is ring-shaped, when unsolidified resin is injected from an outer core piece 32 toward an inner core piece 31 via an end surface side of the coil 2 to form the resin mold portion 6, unsolidified resin can be more easily prevented from leaking to the outer circumferential surface of the coil 2. The ring-shaped body portion 517 in this example surrounds the entire circumference of the outer circumferential surface of the inner core piece 31, and substantially no gap is formed between the inner circumferential surfaces of the winding portion 2*a* or 2*b* and the outer circumferential surface of the ring-shaped body portion 517. The thickness of the ring-shaped body portion 517 is adjusted such that the gaps g can be formed between the outer circumferential surface of the inner core piece 31 and the inner circumferential surface of the ring-shaped body portion 517 (FIG. 3D).

The outer circumferential surface of the ring-shaped body portion 517 is constituted by a uniform flat surface (FIGS. 3A and 2), and is substantially in contact with the inner circumferential surface of the winding portion 2*a* or 2*b* (FIG. 3D). The inner circumferential surface of the ring-shaped body portion 517 has a shape with recesses and protrusions due the thickness thereof being partially different. Specifically, the thickness of the four corners of the ring-shaped body portion 517 and the vicinity thereof is larger than the thickness of other portions so that there are protruding portions toward the inner circumferential surface side (FIG. 2). These thick wall portions are defined as the end portion-side protruding portions 5176. Steps are formed between the end portion-side protruding portions 5176 and other thin wall portions that are thin (FIGS. 3A and 2). Therefore, as shown in FIG. 3D, in a state where an inner core piece 31 and a ring-shaped body portion 517 are assembled, the gaps g that correspond to the protruding height of the end portion-side protruding portions 5176 from the inner circumferential surface of the thin wall portion are provided. In this example, four gaps g are formed between the four surfaces of the inner core piece 31 and the thin wall portion.

The thickness (or the protruding height) of the end portion-side protruding portions 5176 and the thickness of the thin wall portion may be selected as appropriate so that the above-described gaps g (the above-described steps) have a predetermined value. The larger the gaps g are (the larger the thickness of the end portion-side protruding portions 5176 is, or the smaller the thickness of the thin wall portion is), the easier it is to inject unsolidified resin, which improves unsolidified resin distribution. The smaller the gaps g are (the smaller the thickness of the end portion-side protruding portions 5176 is, or the larger the thickness of the thin wall portion is), the more stably the inner core piece 31 is supported by the end portion-side protruding portions 5176.

The areas where the end portion-side protruding portions 5176 are formed can be selected as appropriate. As in this example, if the end portion-side protruding portions 5176 are provided at the four corners and the vicinity thereof of the ring-shaped body portion 517 that has a rectangular frame shape, the above-described gaps g are large enough to secure satisfactory resin flow paths. For example, it is possible to further increase the resin flow path by employing a configuration in which the end portion-side protruding portions 5176 are provided at only two corners at diagonal positions and the vicinity thereof of the ring-shaped body portion 517. Alternatively, for example, by employing a configuration in which an end portion-side protruding portion 5176 can support the entirety of one surface of the inner core piece 31, it is possible to increase the contact areas of the end portion-side protruding portions 5176 and the outer circumferential surface of the inner core piece 31, and support the inner core piece 31 in a more stable state.

The end portion divisional piece 515 in this example is provided with, in addition to the ring-shaped body portion 517 that is interposed between the inner circumferential surfaces of the winding portion 2*a* or 2*b* of the coil 2 and the outer circumferential surface of the magnetic core 3A, the end surface restriction portions 5178 that cover portions of the surface that faces the outer core pieces 32, of the inner core piece 31 (FIG. 4), and that restrict the inner core piece 31 from moving toward the outer core piece 32. In FIGS. 2 and 3A, plate pieces protrude from the four corners of the ring-shaped body portion 517 toward the inside of the ring-shaped body portion 517, and thus cover the above-described four corners. These plate pieces constitute the end surface restriction portions 5178. Each plate piece has a roughly rectangular shape, and the corner that is connected to the outer circumferential surface of the ring-shaped body portion 517 is rounded. For example, the shape and number of the end surface restriction portions 5178, and the proportion of the area of the end surface restriction portions 5178, which covers the end surface of the inner core piece 31, may be selected as appropriate. The larger the proportion of the areas is (e.g. a plate piece that bridges between two corners of the ring-shaped body portion 517 is employed, or the number of end surface restriction portions 5178 is increased), the more possible it is to reliably restrict the inner core piece 31 from moving toward the outer core pieces 32. The smaller the proportion of the above-described area is, the larger the contact area, with a resin gap portion, of the end surface of the inner core piece 31 and the inner end surface 32*e* of the outer core piece 32 are, in this example. As a result, it can be expected that the bonding strength of the inner core pieces 31 and the outer core pieces 32 will be improved. To improve the bonding strength, the end surface restriction portions 5178 may be downsized, and areas where the resin gap portions are formed may be enlarged. The proportion of the area of the inner core piece 31 not covered by the end surface restriction portions 5178 may be, for example, greater than or equal to 50%, greater than or equal to 60%, greater than or equal to 70%, or, furthermore, greater than or equal to 80%. If four end surface restriction portions 5178 are provided so as to press the four corners of the inner core piece 31, which is square-shaped as in this example, the proportion of the total area of portions of the inner core piece 31 covered by the end surface restriction portions 5178 is relatively large, and the above-described inner core piece 31 is likely to be restricted from moving. In addition, since a plurality of end surface restriction portions 5178 are provided, the gaps between the end surface restriction portions 5178 can be used as resin flow paths for the resin mold portion 6, and the above-described gap portions can be easily formed. In this example, the areas of the ring-shaped body portion 517 where the end portion-side protruding portions 5176 are formed and where the end surface restriction portions 5178 are formed match in the circumferential direction. Therefore, in a state where the inner core piece 31 and the end portion divisional piece 515 are assembled, the gaps g are provided (FIG. 3D).

Frame Plate Portions

As shown in FIG. 2, each frame plate portion 52 in this example is a frame member that is provided with, in a central portion thereof, a pair of through holes 52*h* through which end surfaces of inner core pieces 31, which are located in the winding portions 2*a* and 2*b*, are exposed toward the inner end surface 32*e* of an outer core piece 32. On the side (hereinafter referred to as the coil side) of each frame plate portion 52, which is located so as to face end surfaces of the winding portions 2*a* and 2*b*, a pair of through holes 52*h* are arranged side by side. In this example, the side (hereinafter referred to as the outer core side) of each frame plate portion 52, which is located so as to face the inner end surface 32*e* of an outer core piece 32, is recessed such that the inner end surface 32*e* of the outer core piece 32 can be fitted thereinto. Two through holes 52*h* are open in a bottom portion of this recess. Each frame plate portion 52 is provided with core holes 52*f* on the outer core side. The core holes 52*f* are open in the opening edge of the above-described recess, and form spaces that are in communication with the through holes 52*h* (see the frame plate portion 52 on the left in FIG. 2). An outer core side central portion of the frame plate portion 52 is recessed, and thus the thickness of this central portion is smaller than the thickness of the peripheral portion. When the inner core pieces 31, the outer core pieces 32, and the frame plate portions 52 are assembled, the central portions of the frame plate portions 52 are interposed between the inner core pieces 31 and the outer core pieces 32. Therefore, the interval between the inner core pieces 31 and the outer core pieces 32 is kept to a length corresponding to the thickness of the above-described central portions. In the manufacturing process, the gaps that are formed between the inner core pieces 31 and the outer core pieces 32 due to the presence of the above-described central portions are used as resin flow paths, and are ultimately filled with a portion of the resin mold portion 6. Therefore, the reactor 1A is also provided with resin gap portions between the inner core pieces 31 and the outer core pieces 32.

Coil Side

The frame plate portions 52 in this example are provided with fitting grooves on the coil side, into which portions in the vicinity of the end surfaces of the winding portions 2*a* and 2*b* are fitted. The fitting grooves are ring-shaped so as to match the shapes of the end surfaces of the winding portions 2*a* and 2*b* (see the frame plate portion 52 outer interposed portion 52 on the right side in FIG. 2). The portions in the vicinity of the end surfaces of the winding portions 2*a* and 2*b* are fitted into the fitting grooves, and thus the coil 2 and the frame plate portions 52 can be positioned. Central portions of the fitting grooves are respectively provided with the through holes 52*h* that have substantially the same size as the inner circumferential contours of the winding portions 2*a* and 2*b*, or a slightly larger size than the inner circumferential contours.

In addition, in this example, the fitting grooves are provided with recessed portions 520 in which the corners of the end surfaces of the winding portions 2*a* and 2*b* are housed (see the frame plate portion 52 on the right side in FIG. 2). Here, when a winding wire 2*w* is wound so as to form a tubular shape, an inner circumference side area of this tubular member is more likely to bulge in the axial direction of the tubular member compared to an outer circumference side area thereof. As in this example, if the winding portions 2*a* and 2*b* are edgewise coils, and the end surfaces thereof have a square shape with rounded corners, for example, the bending radius of each corner is small, and the above-described bulging is likely to occur at the corners. The frame plate portions 52 are provided with the recessed portions 520, into which such bulging inner circumference side areas (the corners and the vicinity thereof) are fitted. Thus, the winding portions 2*a* and 2*b* and the frame plate portions 52 come into intimate contact. Furthermore, the frame plate portions 52 in this example are also provided with draw-out grooves on the coil side, which are provided so as to extend in a direction in which the other end portions of the winding wires 2*w* in the winding portions 2*a* and 2*b* are drawn out. Therefore, the winding portions 2*a* and 2*b* and the frame plate portions 52 are more likely to come into intimate contact. As a result of the winding portions 2*a* and 2*b* and the frame plate portions 52 being in intimate contact, it is easy to prevent the above-described unsolidified resin from leaking to the outer circumferential surface side of the coil 2.

Outer Core Side

The dimensions of an imaginary surface formed by the opening edges of the core holes 52*f* provided in each frame plate portion 52 in this example on the outer core side is slightly larger than the dimensions of the inner end surfaces 32*e* of the outer core pieces 32. Therefore, when the outer core pieces 32 are fitted into the core holes 52*f* in the manufacturing process, gaps are provided between the outer peripheral surfaces of the outer core pieces 32 and the inner peripheral surfaces that form the core holes 52*f*. In the right half of FIG. 4, such a gap is provided between the surface (upper surface) opposite to the installation surface and the side surface (right surface) of the outer core piece 32, and a portion of the inner peripheral surface that forms the core hole 52*f* the portion overlapping the opening edge of the through hole 52*h*. These gaps are used as resin flow paths in the manufacturing process, and ultimately, portions of the resin mold portion 6 (in FIG. 4, portions of the inner covering portions 61 described below, the portions overlapping an upper portion and a right portion) are provided. Also, when the coil 2 and the interposed member 5A are assembled, and they, without the outer core pieces 32, are seen from the outer core side of a frame plate portion 52, the winding portions 2*a* and 2*b* are covered by the frame plate portion 52 and cannot be seen as shown in the right half of FIG. 4. An end surface of the inner core piece 31 and the end surface restriction portions 5178 of the end portion divisional pieces 515 are exposed from the through hole 52*h*, and can be seen. With such a configuration, it is possible to inject unsolidified resin into the winding portions 2*a* and 2*b* via the above-described gaps from the outer core side, and it is possible to prevent unsolidified resin from leaking to the outer circumferential surfaces of the winding portions 2*a* and 2*b*, using the frame plate portions 52.

To form the above-described gaps and support the outer core pieces 32, the inner circumferential surface of each core hole 52*f* in this example is provided with a protruding portion 522, which holds the surface (the upper surface) opposite to the installation surface of the outer core piece 32, and a holding surface 523, which holds a portion of the installation surface (the lower surface). A pair of surfaces (the upper and lower surfaces) that face each other of an outer core piece 32 fitted into a core hole 52*f* are sandwiched by the inner end surface of the protruding portion 522 and the holding surface 523, and are thus positioned by a frame plate portion 52. Also, gaps are provided between the upper surfaces of the outer core pieces 32 and the opening edges of the core holes 52*f* and side surfaces of the outer core pieces 32 and the opening edges of the core holes 52*f* (see and compare between the two-dot chain line and the core hole 52*f* in FIG. 4). The dimensions and shapes of the core holes 52*f*, the protruding portions 522, and the holding surfaces 523 may be selected as long as predetermined gaps can be provided.

In addition, in this example, the frame plate portions 52 are each provided with pin grooves 59 on the installation surface side (lower side), into which pins 9 (FIG. 2) that protrude from the inner surface of a mold (not shown) are inserted when the resin mold portion 6 is formed (FIGS. 2 and 4). The thickness of the peripheral portions of the the frame plate portions 52 is large enough so that the pin grooves 59 can be formed. FIG. 2 shows examples of the pins 9 that are each formed by rounding one corner of a rectangular parallelepiped, and are provided with an inclined surface. The inclined surfaces of the pins 9 are in contact with the outer core pieces 32. Non-rounded rectangular surfaces of the pins 9 are in contact with the bottom surfaces of the pin grooves 59. Portions of the inner end surface 32*e* of each outer core piece 32 in this example is provided with cutouts 329 into which pins 9 are inserted, and the above-described inclined surfaces and the surfaces that constitute the cutouts 329 are in contact with each other. The pin grooves 59 are provided so as to extend from the installation surfaces (the lower surfaces) of the frame plate portions 52 to the through holes 52*h* via the core holes 52*f*. In this example, two pin grooves 59 are provided for one frame plate portion 52, and two cutouts 329 are provided for one outer core piece 32. Before the resin mold portion 6 is formed, when the pins 9 are inserted into holes (not shown) that are defined by the cutouts 329 and the pin grooves 59 in a state where the outer core pieces 32 and the frame plate portions 52 are assembled, the outer core pieces 32 can be prevented by the pins 9 from moving in a direction in which the outer core pieces 32 come close to each other. In particular, the outer core pieces 32 are less likely to be displaced relative to the mold even when the pressure of the unsolidified resin is large. As a result, it is easy to keep the length from one outer core piece 32 to the other outer core piece 32 constant. That is, it is easy to keep the interval between the inner core pieces 31.

Dimensions

The dimensions of the frame plate portions 52 in this example are such that, in a state where the frame plate portions 52 and the coil 2 are assembled, the installation surfaces (the lower surfaces) of the winding portions 2*a* and 2*b* do not protrude from the installation surfaces (the lower surfaces) of the frame plate portions 52, and the side surfaces (the left and right surfaces) of the winding portions 2*a* and 2*b* are substantially flush with the side surfaces (the left and right surfaces) of the frame plate portions 52. Therefore, in the above-described assembled state, the coil 2, excluding end portions of the winding wires 2*w*, does not protrude from the outer interposed portions 52. Also, the dimensions of the frame plate portions 52 are such that, in a state where the coil 2 and the outer core pieces 32 are assembled, the surfaces (the upper surfaces) opposite to the installation surfaces of the frame plate portions 52 are located higher than the surfaces (the upper surfaces) opposite to the installation surfaces of the winding portions 2*a* and 2*b* and the outer core pieces 32.

Constituent Materials

Examples of the constituent material of the interposed member 5A include insulative materials such as various kinds of resins. For example, a polyphenylene sulfide (PPS) resin, a polytetrafluoroethylene (PTFE) resin, a liquid crystal polymer (LCP), a polyamide (PA) resin such as nylon 6 or nylon 66, and a thermoplastic resin such as a polybutylene terephthalate (PBT) resin or an acrylonitrile butadiene styrene (ABS) resin may be used. Alternatively, it is possible to use a thermosetting resin such as an unsaturated polyester resin, an epoxy resin, a urethane resin, or a silicone resin. The interposed member 5A can be easily manufactured using a known molding method such as injection molding using the above-described resins.

Resin Mold Portion

The resin mold portion 6 in this example mainly covers portions of the magnetic core 3A not covered by the interposed member 5A as shown in FIG. 1, to hold the plurality of inner core pieces 31 and the outer core pieces 32 as a ring-shaped integrated member. This resin mold portion 6 includes: inner covering portions 61 that cover the outer circumferential surfaces of the inner core pieces 31; and outer covering portions 62 that cover the outer circumferential surfaces of the outer core pieces 32. The resin mold portion 6 also includes a resin gap portion 60 that is located between inner core pieces 31 that are adjacent to each other. The resin mold portion 6 in this example also includes resin gap portions (not shown) that are each located between an inner core piece 31 and an outer core piece 32.

Resin Gap Portions

The resin gap portions 60 located between the inner core pieces 31 each have the shape of a rectangular flat plate surrounded by an interposed protruding portion 5126 provided in an intermediate divisional piece 510. The surfaces of the flat plate-shaped resin gap portions 60 are in contact with end surfaces of the inner core pieces 31, and also serve as joining members that join the inner core pieces 31 to each other. A portion of a side surface of a resin gap portion 60 is in contact with the inner edge surface of an interposed protruding portion 5126, and another portion of a side surface on a cutout portion 514 side is continuous with an intermediate covering portion 610 described below. The reactor 1A includes a number of (four in total in this example) resin gap portions 60 corresponding to the number of intermediate divisional pieces 510.

A resin gap portion provided between an inner core piece 31 and an outer core piece 32 is surrounded by an inner surface that defines through holes 52*h* in a frame plate portions 52, and therefore has the shape of a square flat plate with rounded corners. One surface of this flat plate-shaped resin gap portion is in contact with the end surface of the inner core piece 31 (excluding the area covered by the end surface restriction portion 5178), and another surface is in contact with the inner end surface 32*e* of the outer core piece 32, and thus the resin gap portion also serves as a joining member that joins the inner core piece 31 and the outer core piece 32 to each other. The reactor 1A includes a number of (four in total in this example) such resin gap portions corresponding to the number of through holes 52*h*.

Inner Covering Portions

The inner covering portions 61 mainly cover portions of the outer circumferential surfaces of inner core pieces 31 exposed from the inner divisional pieces 51 (the intermediate divisional pieces 510 and the end portion divisional pieces 515), that is, a gap provided between intermediate divisional pieces 510 that are adjacent to each other, and a gap provided between an intermediate divisional piece 510 and an end portion divisional piece 515. The inner covering portions 61 in this example each further include an intermediate covering portion 610 (FIG. 1) that fills a step between: a portion of an intermediate divisional piece 510 exposed from a cutout portion 514 in the outer circumferential surfaces of inner core pieces 31 that are adjacent to each other; and a body portion 512. Each intermediate covering portion 610 is continuous with a resin gap portion 60 that is located between inner core pieces 31 that are adjacent to each other. Therefore, when the sets of inner core pieces 31 located in the winding portions 2*a* and 2*b* are seen in the axial direction of the winding portions 2*a* and 2*b*, each inner covering portion 61 includes: an entire circumference covering portion that continuously covers the entire outer circumferential surface of a set of inner core pieces 31 (the upper and lower surfaces, and the left and right surfaces); and a partially covering portion (the intermediate covering portion 610) that only covers a portion of the outer circumferential surface of a set of inner core piece 31 (only the upper surface here). Entire circumference covering portions and partially covering portions are alternatingly arranged, and thus each inner covering portion 61 is formed as one continuous integrated piece overall, and the resin gap portions 60 are also integrated into one piece.

Each inner covering portion 61 in this example further includes a portion that covers the outer circumferential surface of the above-described thin wall portion of a body portion 512 (see FIG. 1 and the two-dot chain line (imaginary line) in FIG. 3E). This portion is continuous with the above-described entire circumference covering portion (FIG. 1). Each inner covering portion 61 in this example also includes end portion covering portions 617 that are interposed between the outer circumferential surface of an inner core piece 31 and the inner circumferential surface of the ring-shaped body portion 517 of an end portion divisional piece 515 (see the two-dotted chain line (imaginary line) in FIG. 3D). In this example, four end portion covering portions 617 that cover the upper and lower surfaces and the left and right surfaces of an inner core piece 31 are provided so as to correspond to four gaps g provided around the inner core piece 31 in the manufacturing process. Such end portion covering portions 617 are continuous with the intermediate covering portion 610 via the above-described entire circumference covering portion.

Outer Covering Portions

The outer covering portions 62 mainly cover portions exposed from the frame plate portions 52, of the outer circumferential surfaces of the outer core pieces 32. Each outer covering portion 62 in this example includes an extension portion that also covers an outer core side surface of a frame plate portion 52 so as to close off a core hole 52*f* that is provided in the outer core side surface of the frame plate portion 52 (FIGS. 1 and 4). The installation surfaces (the lower surfaces) of the extension portions are substantially flush with the installation surfaces (the lower surfaces) of the frame plate portions 52. The surfaces (the upper surfaces) of the extension portions opposite the installation surfaces thereof are located lower than the surfaces (the upper surfaces) of the frame plate portions 52 opposite the installation surfaces thereof, so that step-like shapes are formed, with the extension portions being located at the lower level. The side surfaces (the left and right surfaces) of the extension portions are substantially flush with the side surfaces (the left and right surfaces) of the frame plate portions 52 so as not to protrude from the side surfaces of the frame plate portions 52. The outer covering portions 62 in this example include, on the extension portions' installation surfaces side, protruding pieces thereof (four pieces in this example) that protrude outward of the outer core pieces 32. These protruding pieces serve as attachment portions for fixing the reactor 1A to the installation target. The attachment portions may be omitted.

The inner covering portions 61 and the outer covering portions 62 are continuous via the resin gap portions between the above-described inner core pieces 31 and the outer core pieces 32. That is, the resin mold portion 6 is formed as an integrated member in which the outer covering portions 62, the resin gap portions between the inner core pieces 31 and the outer core pieces 32, the end portion covering portions 617, the portions that cover the gaps between the intermediate divisional pieces 510 and between the intermediate divisional pieces 510 and the end portion divisional pieces 515, the intermediate covering portions 610, and the resin gap portions 60 are continuous.

Constituent Materials

Examples of the constituent resin of the resin mold portion 6 include a PPS resin, a PTFE resin, LCP, a PA resin such as nylon 6, nylon 66, nylon 10T, nylon 9T, or nylon 6T, and a thermoplastic resin such as a PBT resin. If the constituent resin of the resin mold portion 6 is the same as the constituent resin of the interposed member 5A, bonding properties can be excellent, and also, since the thermal expansion coefficient of the resin mold portion 6 and the linear expansion coefficient of the interposed member 5A are the same, peeling, cracking, and the like can be prevented from being caused by thermal stress.

Reactor Manufacturing Method

The reactor 1A provided with resin gap portions 60 can be manufactured by, for example, housing a combined body 10 that includes: the coil 2; the magnetic core 3A; and the interposed member 5A in a mold (not shown), covering the magnetic core 3A with the unsolidified resin, and forming the resin gap portions 60.

In this example, it is possible to use the end surface restriction portions 5178 of the end portion divisional pieces 515 as stoppers for the inner core pieces 31 to sequentially stack an end portion divisional piece 515, an inner core piece 31, an intermediate divisional piece 510, an inner core piece 31, an end portion divisional piece 515, and so on.

In a state where the coil 2, the magnetic core 3A, and the interposed member 5A are assembled, continuous spaces, namely the spaces between one surface of each outer core piece 32 and the core holes 52*f* of the frame plate portions 52, gaps between the end surfaces of the inner core pieces 31 and the inner end surfaces 32*e* of the outer core pieces 32, the gaps g between the inner core pieces 31 and the end portion divisional pieces 515, the gaps between the intermediate divisional pieces 510 and the end portion divisional pieces 515, the gaps $G_{514}$ based on the cutout portions 514 of the intermediate divisional pieces 510, and the gaps between the intermediate divisional pieces 510, are used as unsolidified resin flow paths, as described above. The step-like spaces G between the thick wall portions and the thin wall portions of the intermediate divisional pieces 510 are also used as resin flow paths.

In this example, in a state where the end portion divisional pieces 515 and the intermediate divisional pieces 510 are attached to the inner core pieces 31, the ring-shaped body portions 517 of the end portion divisional pieces 515 are provided so as to overlap the step-like spaces G. As a result, three gaps g that are provided in three surfaces (the lower surface and the left and right surfaces) of each inner core piece 31 from among the four gaps g are not in communication with three step-like spaces G. The remaining one gap g (the upper gap g) provided in one surface (the upper surface) of each inner core piece 31 is in communication with the gaps $G_{514}$. Therefore, it is possible to inject unsolidified resin from the upper gaps g to the gaps $G_{514}$ of the cutout portions 514 of the intermediate divisional pieces 510 via one surface (the upper surface) of each inner core piece 31. That is, as described above, it is possible to limit the direction in which unsolidified resin is injected to inner core pieces 31 that are adjacent to each other, to one direction.

The reactor 1A can be obtained by housing the combined body 10 provided with the above-described resin flow paths in a mold (not shown), injecting unsolidified resin into the mold to fill spaces that serve as the resin flow paths with unsolidified resin, and forming the resin mold portion 6 that is based on the resin flow paths. Injection molding or the like may be employed to form the resin mold portion 6.

The above-described pins 9 protrude from the inner surface of the mold, and are inserted into the pin holes constituted by the cutouts 329 of the outer core pieces 32 and the pin grooves 59 of the frame plate portions 52. Thus, portions of the inner end surfaces 32*e* of the outer core pieces 32 can be supported by the pins 9. As a result, even when the pressure of unsolidified resin is large, the position of the outer core pieces 32 can be fixed relative to the mold.

Uses

The reactor 1A according to the first embodiment can be used as a circuit component that performs a voltage step-up operation or step-down operation, such as a constituent component of various converters or power conversion devices. Examples of the converters include an on-board converter (typically a DC-DC converter) that is mounted on a vehicle such as a hybrid vehicle, a plug-in hybrid vehicle, an electric vehicle, or a fuel cell vehicle, and a converter for an air conditioner.

Effects

The reactor 1A according to the first embodiment can keep the interval between inner core pieces 31 that are adjacent to each other due to the interposed protruding portions 5126 included in the interposed member 5A, and can be provided with gap portions corresponding to the magnitude of the interval. Therefore, with the reactor 1A, it is possible to omit gap plates and the step of joining core pieces and gap plates. Also, it is easier to assemble the inner divisional pieces 51 (the intermediate divisional pieces 510) provided with the interposed protruding portions 5126 and the inner core pieces 31. Therefore, with the reactor 1A, it is possible to keep the interval between the inner core pieces 31 using a simple configuration, and achieve excellent productivity.

In particular, the reactor 1A in this example is provided with the resin mold portion 6 that covers the magnetic core 3A, and is provided with the resin gap portions 60 that are formed using portions of the resin mold portion 6. Therefore, it is possible to form the resin mold portion 6 and the resin gap portions 60 at the same time, and it is possible to achieve excellent productivity from this viewpoint as well. In particular, for the following reasons, resin flow paths can be satisfactorily secured around the inner core pieces 31, which improves the distribution of unsolidified resin that is used to form the resin mold portion 6, and the productivity of the reactor 1A in this example is excellent from this viewpoint as well.

(1) The intermediate divisional pieces 510 and the end portion divisional pieces 515 provided in each of the winding portions 2*a* and 2*b* are separated from each other in the axial direction of the winding portions 2*a* and 2*b*.

(2) The intermediate divisional pieces 510 are provided with the cutout portions 514 and the thin wall portions, and thus the gaps $G_{514}$ and the step-like spaces G can be formed.

(3) The end portion divisional pieces 515 are provided with the end portion-side protruding portions 5176, and the gaps g can be formed between the end portion divisional pieces 515 and the inner core pieces 31.

Furthermore, since the gap portions between the inner core pieces 31 are formed by the interposed protruding portions 5126 and the resin gap portions 60, it is possible to more reliably keep the interval between the inner core pieces 31, and prevent inductance from fluctuating. Therefore, the reactor 1A can keep a predetermined inductance over a long time. As in this example, the intermediate divisional pieces 510 have a specific shape, and the direction in which unsolidified resin is injected to the gaps between the inner core pieces 31 is restricted in the manufacturing process. Thus, from this viewpoint as well, it is possible to appropriately form the resin gap portions 60, and the reactor 1A can keep a predetermined inductance.

The resin gap portions 60 included in the resin mold portion 6 join the inner core pieces 31 with each other, and the inner core pieces 31 and the outer core pieces 32. Also, in this example, for the reason (1) above, sufficiently large areas of the inner core pieces 31 are covered by the resin mold portion 6. Therefore, the mechanical strength of the reactor 1A, into which the magnetic core 3A is integrated, is improved by the resin mold portion 6. Also, due to the resin mold portion 6 being provided, it can be expected that the reactor 1A will be protected from external factors (especially, corrosion protection for the outer core pieces 32, for example), vibrations and noise will be prevented from occurring, insulation will be improved, and, depending on the constituent material, heat dissipation properties will be improved, for example.

In addition, the reactor 1A in this example achieve the following effects.

(1) Since the end portions of the winding wires 2*w* are drawn out upward away from the winding portions 2*a* and 2*b*, and the frame plate portions 52 are provided with the fitting grooves, the recessed portions 520, and the draw-out grooves, the coil 2 and the frame plate portions 52 can be in intimate contact with each other. Since the winding portions 2*a* and 2*b* are sandwiched between such frame plate portions 52, there are substantially no gaps between the turns of the winding portions 2*a* and 2*b*. Therefore, it is possible to realize a downsized reactor 1A. Using the above-described pins 9, it is possible to adjust the length of the coil 2 while keeping the interval between the outer core pieces 32 constant, by, for example, pressing the frame plate portions 52.

(2) Since the inner end surfaces 32*e* of the outer core pieces 32 and the end surfaces of the inner core pieces 31 are uniform flat surfaces, and the central portion of each frame plate portion 52 is interposed between an outer core piece 32 and an inner core piece 31, resin gap portions with a uniform thickness can be provided between the outer core pieces 32 and the inner core pieces 31.

(3) As described above, the coil 2 and the frame plate portions 52 can be in intimate contact with each other, and the unsolidified resin injected from each outer core piece 32 side is unlikely to leak toward the outer circumferential surface side of the coil 2. Therefore, it is easier to manufacture a reactor 1A in which only the magnetic core 3A is covered by the resin mold portion 6 and the coil 2 is exposed to the outside.

(4) Since the peripheral portions of the frame plate portions 52 are thick, it is possible to increase the injection pressure of unsolidified resin. By increasing the injection pressure, it is possible to inject unsolidified resin in a short time even if the resin flow paths are narrow, and thus productivity is excellent.

(5) Since the coil 2 is exposed to the outside without being covered by the resin mold portion 6, when performing cooling using a liquid refrigerant or cooling using a fan, the coil 2 can come into direct contact with the liquid refrigerant or the convective gas, which leads to excellent heat dissipation properties.

In addition, the reactor 1A according to the first embodiment may be provided with at least one of the following. The same applies to the second and third embodiments and modifications below.

(1) sensors (not shown) for measuring physical amounts regarding the reactor 1A, such as a temperature sensor, a current sensor, a voltage sensor, a magnetic flux sensor, and so on;

(2) a heat dissipation plate (such as a metal plate) that is attached to at least a portion (such as the installation surface) of the outer circumferential surface of the coil 2; and (3) a bonding layer (e.g. an adhesive layer, preferably with excellent insulative properties) that is interposed between the installation surface of the reactor 1A and the installation target or the heat dissipation plate described in (2).

Figure 5:
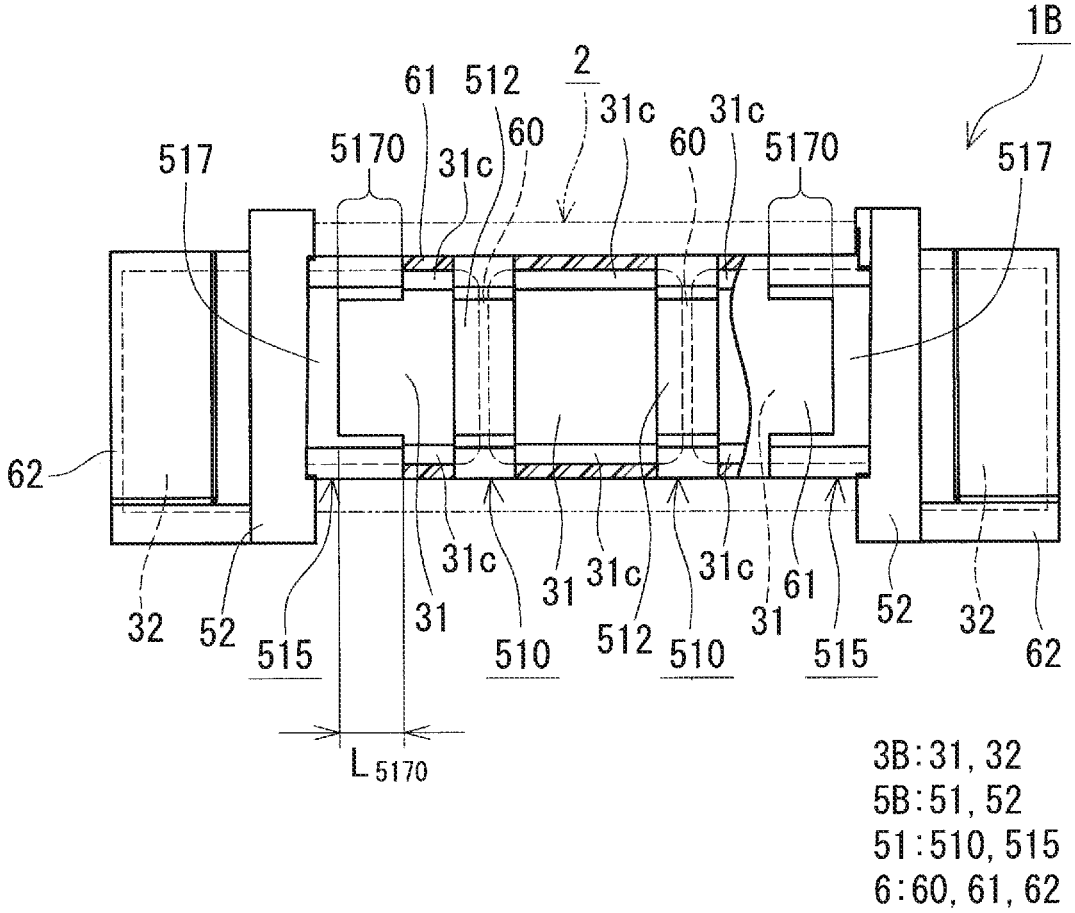
FIG. 5 is a schematic side view showing a reactor according to a second embodiment.
Figure 6:
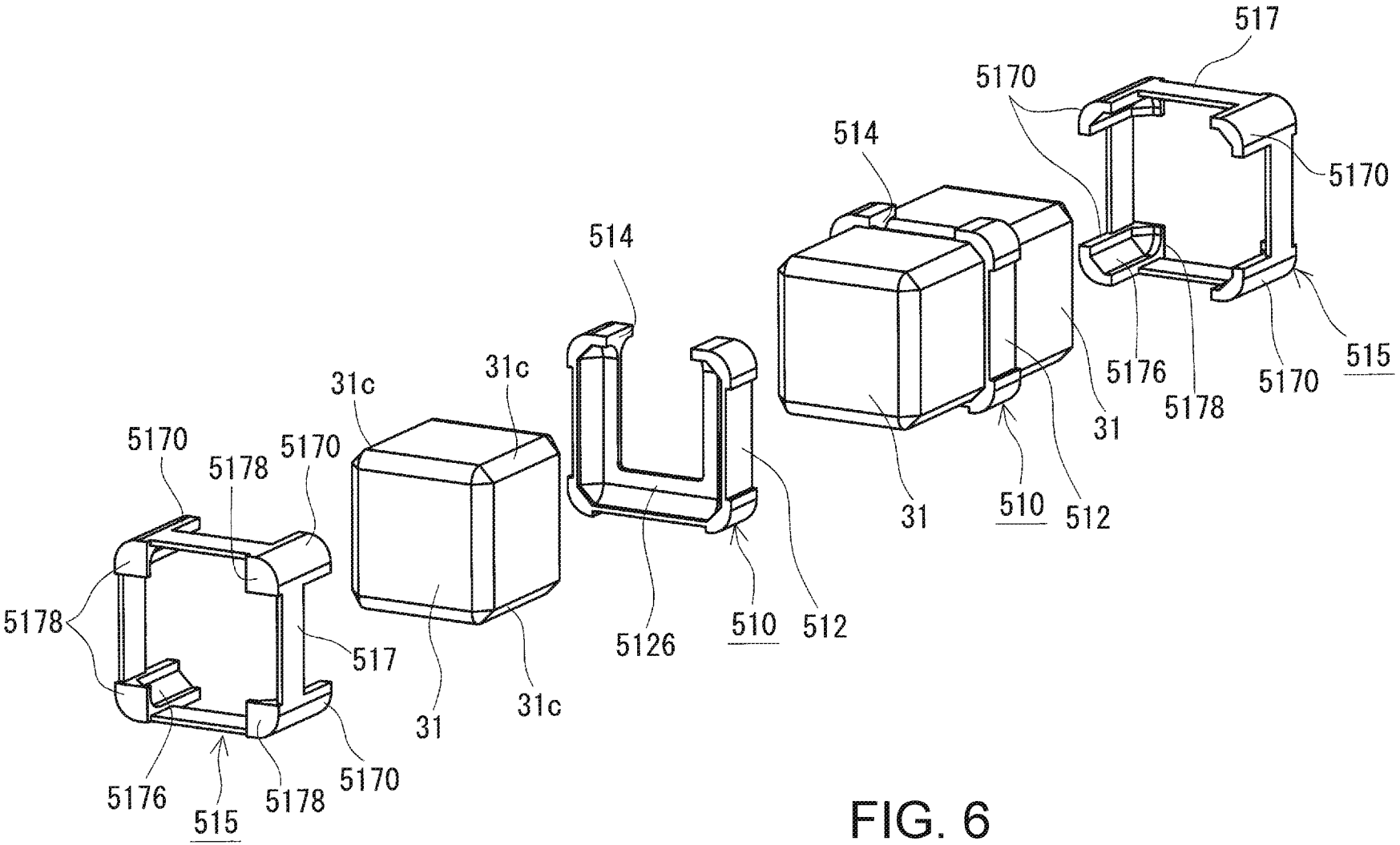
FIG. 6 is an exploded perspective view of inner core pieces and inner divisional pieces that are included in the reactor according to the second embodiment.
Figure 7:
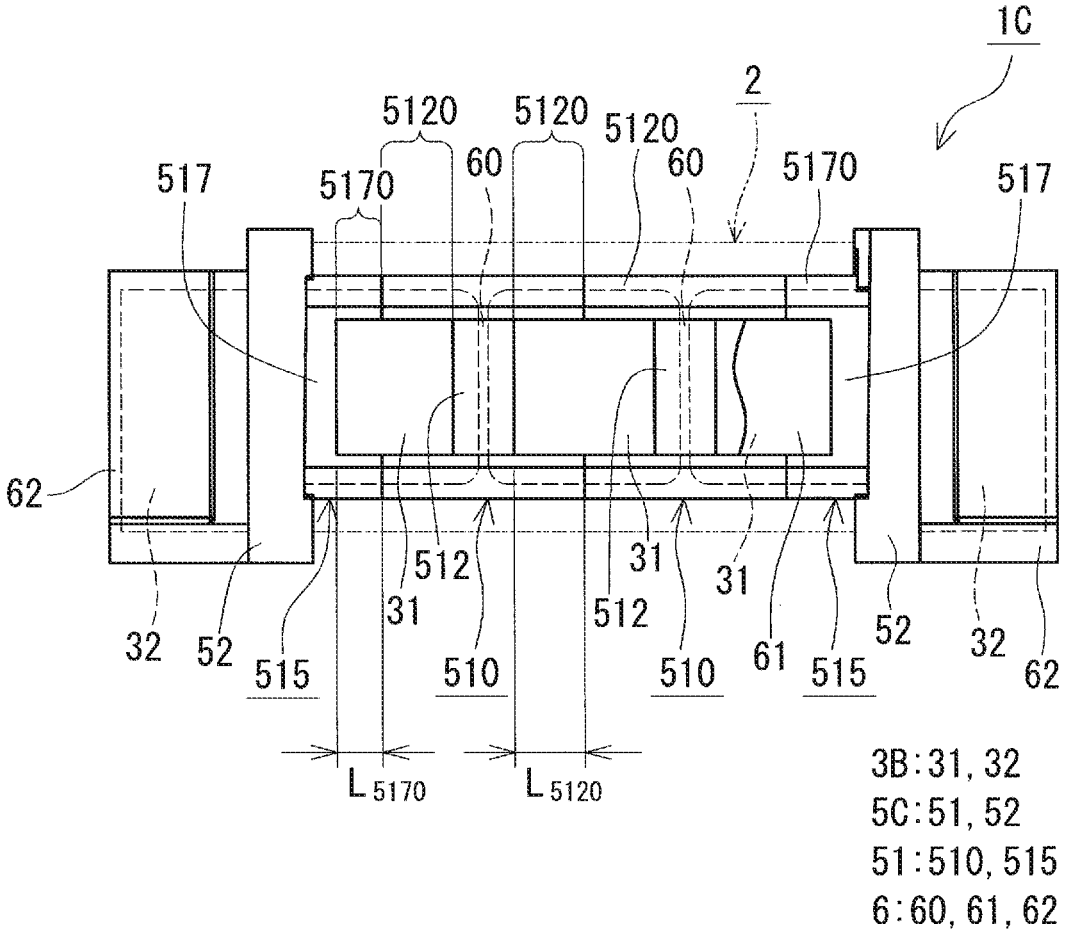
FIG. 7 is a schematic side view showing a reactor according to a third embodiment.
Figure 8:
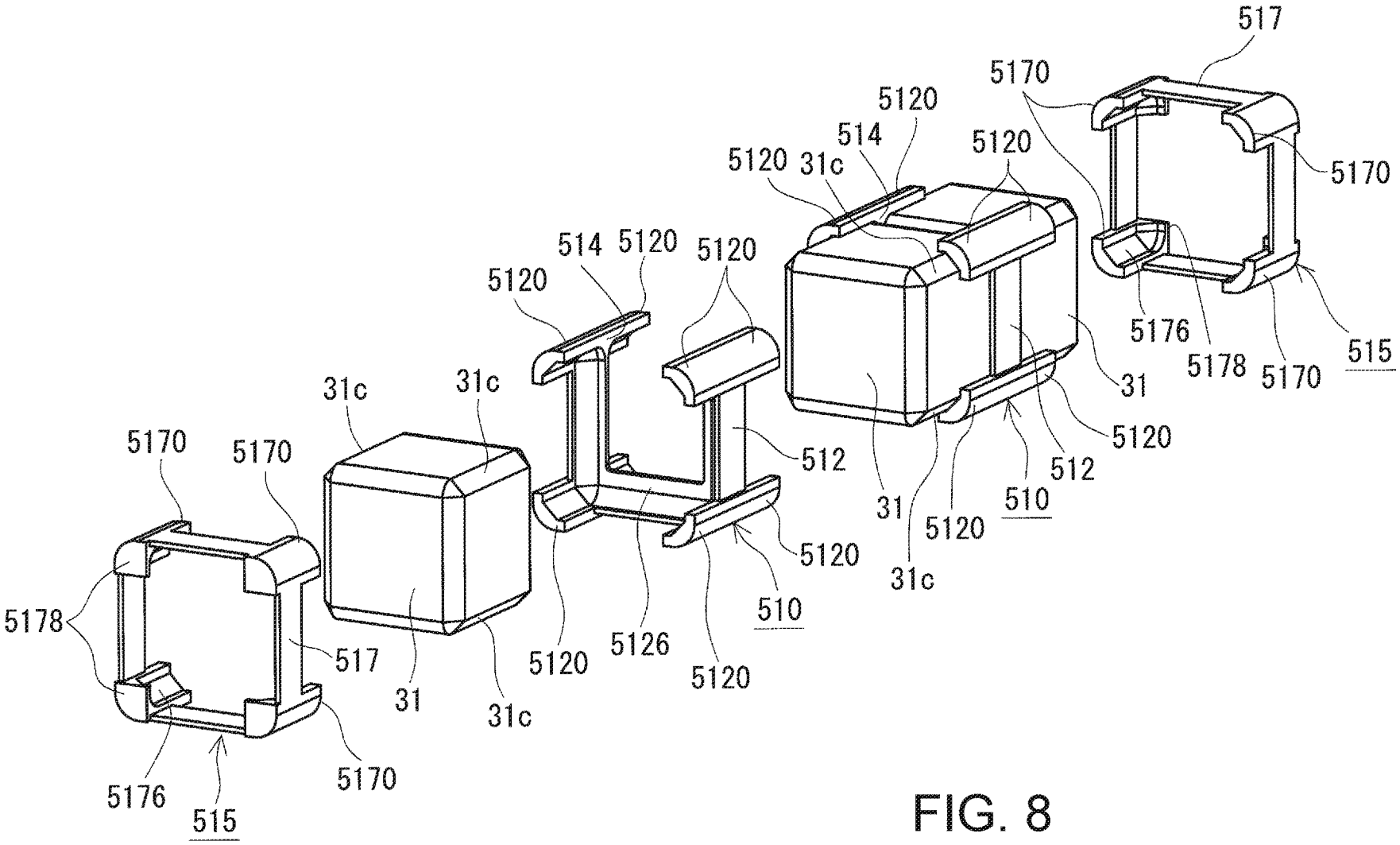
FIG. 8 is an exploded perspective view of inner core pieces and inner divisional pieces that are included in the reactor according to the third embodiment.
Figure 9:
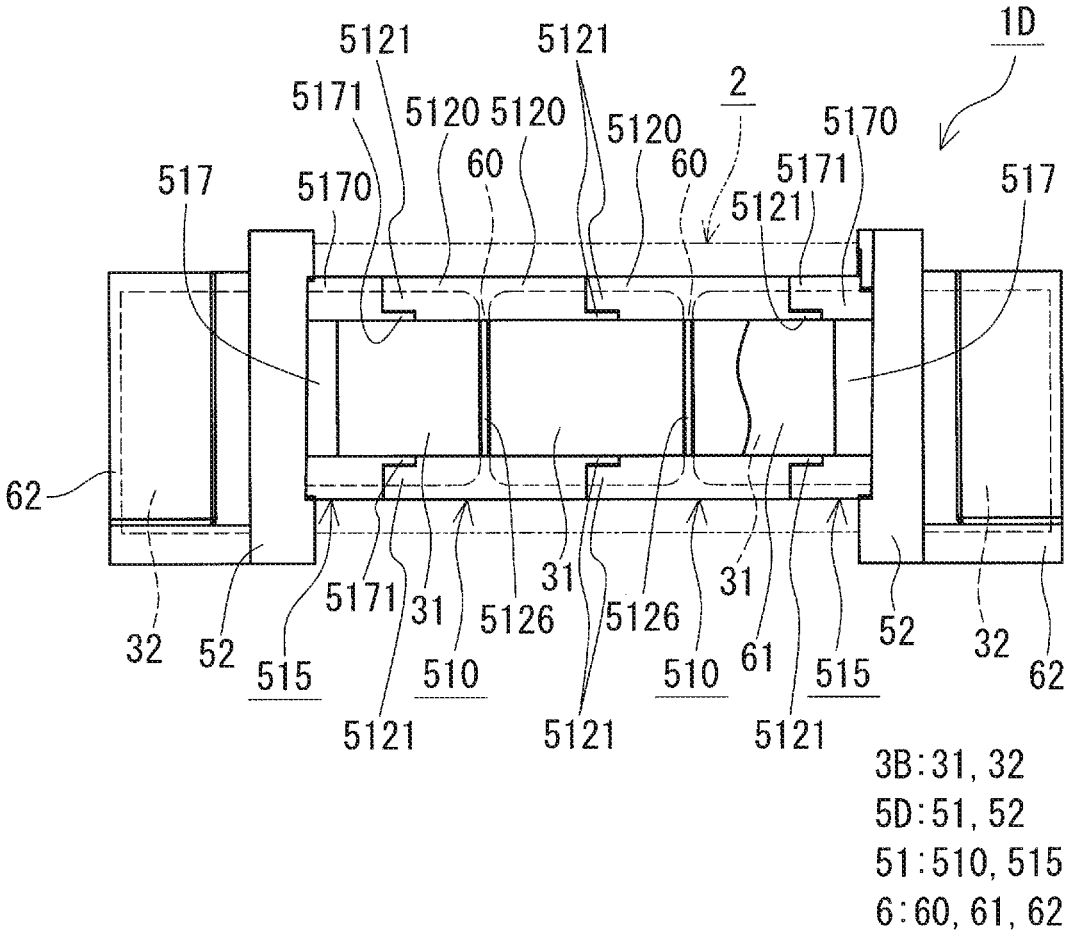
FIG. 9 is a schematic side view showing a reactor according to a fourth embodiment.
Figure 10:
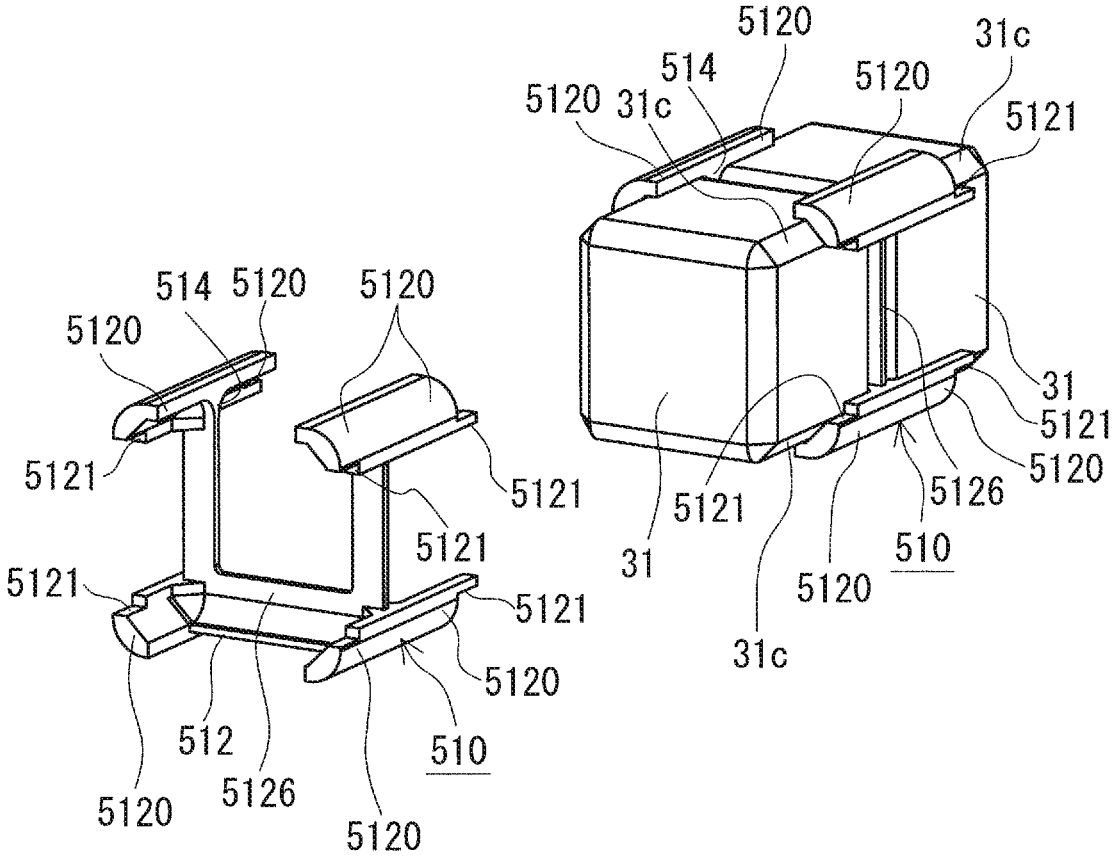
FIG. 10 is an exploded perspective view of some of the inner core pieces and inner divisional pieces that are included in the reactor according to the fourth embodiment.

The following describes a reactor 1B according to the second embodiment with reference to FIGS. 5 and 6, a reactor 1C according to the third embodiment with reference to FIGS. 7 and 8, and a reactor 1D according to the fourth embodiment with reference to FIGS. 9 and 10.

In FIGS. 5, 7, and 9, the coil 2 is expressed using an imaginary line to facilitate understanding, and portions of the resin mold portion 6 that cover the plurality of inner core pieces 31 are partially cut out, so that the inner core pieces 31 and the inner divisional pieces 51 are exposed to the outside. The outer circumferential surfaces of the inner divisional pieces 51 and the outer circumferential surface of the resin mold portion 6 that is located in the winding portions of the coil 2 are roughly flush.

The basic configurations of the reactor 1B according to the second embodiment, the reactor 1C according to the third embodiment, and the reactor 1D according to the fourth embodiment are the same as that of the reactor 1A according to the first embodiment. In summary, the reactors 1B, 1C, and 1D each include a coil 2 that includes a pair of winding portions (not shown), the inner core pieces 31, the outer core pieces 32, and the gap portions, and each also include a magnetic core 3B that is provided inside and outside the winding portions, and an interposed member 5B, 5C, or 5D that is interposed between the coil 2 and the magnetic core 3B. The interposed members 5B, 5C, and 5D each include a plurality of inner divisional pieces 51 and frame plate portions 52. The inner divisional pieces 51 include: intermediate divisional pieces 510 that include interposed protruding portions 5126 (FIGS. 6, 8, and 10); and a pair of end portion divisional pieces 515. Furthermore, the reactors 1B, 1C, and 1D each include a resin mold portion 6 that covers a portion of the outer circumferential surface of the magnetic core 3B. The resin mold portion 6 includes: resin gap portions 60 that are interposed between core pieces; inner covering portions 61 that cover portions of the outer circumferential surfaces of the inner core pieces 31; and outer covering portions 62 that cover portions of the outer circumferential surfaces of the outer core pieces 32. The coil 2 is exposed from the resin mold portion 6. The reactor 1B according to the second embodiment, the reactor 1C according to the third embodiment, and the reactor 1D according to the fourth embodiment mainly differ from the reactor 1A according to the first embodiment in the shape of the inner divisional pieces 51. The following describes the differences in detail, and descriptions of details of other configurations and so on will be omitted.

Second Embodiment

In the reactor 1B according to the second embodiment, the outer circumferential surface of an inner core piece 31 of the magnetic core 3B, to which an inner divisional piece 51 of the interposed member 5B is attached, has a shape with corners, and end portion divisional pieces 515 that are located on the end surface sides of the winding portions of the coil 2, from among the inner divisional portions 51, are provided with end portion claw portions 5170 described below.

The inner core pieces 31 each have a rectangular parallelepiped shape with flat chamfered corners (FIG. 6). Each inner core piece 31 has the shape of a square with flat chamfered corners 31*c* in plan view seen in the axial direction of the coil 2 and in plan view seen in a direction that is orthogonal to the axial direction of the coil 2 (see the dashed lines in FIG. 5). Due to such a shape, the dimensions of a gap between inner core pieces 31 that are adjacent to each other is larger on the outer circumferential surface side (the upper side and the lower side in FIG. 5) than on the center side. Therefore, in a state where inner core pieces 31 that are adjacent to each other and the intermediate divisional pieces 510 are assembled as shown in FIG. 6, it is possible to widen the resin flow paths that are continuous with the cutout portions 514, and it is easy to inject unsolidified resin into the gaps between the inner core pieces 31, and thus productivity is excellent.

The end portion divisional pieces 515 in this example each include the ring-shaped body portion 517 that surrounds the outer circumferential surface of an inner core piece 31 with the above-described corners, in the circumferential direction, and end portion claw portions 5170 that protrude from the ring-shaped body portion 517 so as to cover the corners 31*c* of the inner core piece 31. In this example, each end portion divisional piece 515 is provided with four end portion claw portions 5170 respectively corresponding to four corners 31*c* of one inner core piece 31. Each end portion claw portion 5170 protrudes from the ring-shaped body portion 517 in the axial direction thereof, and are arranged along the corners 31*c* of the inner core piece 31 so as to cover the corners 31*c*.

Here, the corners 31*c* of each inner core piece 31 extend in the axial direction of the coil 2, and a relatively large gap occurs between portions of the inner core piece 31 that are not covered by an inner divisional piece 51, and the inner circumferential surfaces of the winding portions of the coil 2. The end portion claw portions 5170 are members that increase the distance by which unsolidified resin flows, from the above-described relatively large gaps to the outer circumferential surfaces of the winding portions via the end surfaces of the winding portions. With the end portion claw portions 5170, it is possible to cover the outer circumferential surface of the magnetic core 3B and accurately form the resin mold portion 6 that does not cover the outer circumferential surface of the coil 2.

The longer the length $L_{5170}$ of the end portion claw portions 5170 in the axial direction of the coil 2 is (here, the length of the protrusion from the ring-shaped body portion 517, in the axial direction of the ring-shaped body portion 517), the longer the above-described flow distance is. Therefore, even if unsolidified resin that has been injected from an outer core piece 32 side to the inner core piece 31 side flows backward, the unsolidified resin is less likely to leak to the outer circumferential surface side of the coil 2 via an end surface of the winding portions of the coil 2. For example, the length $L_{5170}$ of the end portion claw portions 5170 may be set so that the end portion claw portions 5170 come into contact with an intermediate divisional piece 510. The length $L_{5170}$ of the end portion claw portions 5170 is set to be no less than the minimum length that can prevent unsolidified resin from leaking to the outer circumferential surface side of the coil 2, according to the filling conditions of unsolidified resin, the material of unsolidified resin, the shape and dimensions of the core pieces, the dimensions of the resin flow paths, and so on.

Also, the longer the length of the end portion claw portions 5170 in the circumferential direction of the inner core piece 31 is (here, the length in the circumferential direction of the ring-shaped body portion 517, which is hereinafter referred to as a circumferential length), the less likely unsolidified resin is to leak to the outer circumferential surface side of the coil 2 even if unsolidified resin flows backward. In contrast, the shorter the circumferential length of the end portion claw portions 5170 is, the larger the contact area between the inner core piece 31 and the resin mold portion 6 is, and also the larger the resin flow paths are, which improves unsolidified resin distribution. As shown in this example, if the circumferential length of the end portion claw portions 5170 is roughly the same as the dimensions of the corners 31*c* of the inner core piece 31, it is possible to achieve effects such as excellent unsolidified resin distribution, and improvements in mechanical properties of the magnetic core 3B due to the resin mold portion 6 being provided, while preventing unsolidified resin from leaking to the outer circumferential surface side of the coil 2 when flowing backward, as described above.

Note that the end portion claw portions 5170 in this example are each provided with an end portion-side protruding portion 5176 that extends from the ring-shaped body portion 517 (FIG. 6).

In this example, each end portion claw portion 5170 (FIG. 5) has the same length $L_{5170}$ and the same circumferential length. However, it is possible to provide an end portion claw portion that is different in at least one of the length $L_{5170}$ and the circumferential length. Also, in this example, the pair of end portion divisional pieces 515 have the same shape, and are provided with the same number of end portion claw portions 5170 as the corners 31*c* of each inner core piece 31. However, the specifications (the number, the length $L_{5170}$, the circumferential length, and so on) of the end portion claw portions 5170 of the end portion divisional pieces 515 may differ from each other. For example, at least one of the end portion divisional pieces 515 may be provided with a smaller number of end portion claw portions than corners 31*c* of an inner core piece 31.

Third Embodiment

The reactor 1C according to the third embodiment includes the same magnetic core 3B as in the second embodiment, and an interposed member 5C. One difference between the reactor 1C according to the third embodiment and the second embodiment is the shape of the intermediate divisional pieces 510 included in the interposed member 5C. The outer circumferential surface of an inner core piece 31 of the magnetic core 3B, to which an inner divisional piece 51 of the interposed member 5C is attached, has a shape with corners. The intermediate divisional pieces 510 that are located at intermediate positions in the axial direction of the winding portions of the coil 2, from among the inner divisional pieces 51, are provided with intermediate claw portions 5120 described below. The end portion divisional pieces 515 in this example have a shape that is similar to the shape of those in the second embodiment, and are each provided with end portion claw portions 5170, but the length $L_{5170}$ is different (is shorter in this example).

The intermediate divisional pieces 510 in this example each include: the body portion 512 that continuously covers a portion of the outer circumferential surfaces of inner core pieces 31 that are adjacent to each other; the cutout portion 514 from which the above-described portions of the outer circumferential surfaces are exposed so that the body portion 512 is disconnected in the circumferential direction; and the intermediate claw portions 5120 that protrude from the body portion 512 so as to cover the corners 31*c* of the inner core pieces 31.

Here, if the corners 31*c* of each inner core piece 31 extend in the axial direction of the coil 2 and each inner core piece 31 is not covered by an inner divisional piece 51, the corners 31*c* of each inner core piece 31 come into direct contact with unsolidified resin, and areas at or near which the resin mold portion covers the corners 31*c* may be stress concentration areas. If the resin mold portion locally has stress concentration areas, a crack is likely to occur when the reactor 1C is used. The intermediate claw portions 5120 are members that prevent the corners 31*c* of the inner core pieces 31 from coming into direct contact with the resin mold portion 6. In this example, in order to prevent the corners 31*c* of the inner core pieces 31 and the resin mold portion 6 from coming into contact with each other, every inner core piece 31 (three inner core pieces 31 in this example) is configured to not be in contact with the resin mold portion 6 along the entire length of every corner 31*c* thereof (four corners 31*c* in this example) in the axial direction of the coil 2.

Specifically, intermediate claw portions 5120 extend from two sides of the body portion 512 of each intermediate divisional piece 510, in opposite directions (FIG. 8). Each intermediate claw portion 5120 protrudes from the body portion 512 in the axial direction of the inner core piece 31 (the axial direction of a ring shape when it is assumed that the body portion 512 does not have a cutout portion 514), and is arranged along a corner 31*c* of the inner core piece 31 so as to cover the corner 31*c*. In a state where a body portion 512 is located near a position where inner core pieces 31 that are adjacent to each other face each other, the intermediate claw portions 5120 cover the corners 31*c* such that one intermediate claw portion 5120 extend to the other intermediate claw portion 5120 via a portion of the body portion 512 and the intermediate claw portions 5120 extend from a central portion of one inner core piece 31 to a central portion of the other inner core piece 31 along the corners 31*c* of the inner core pieces 31 that are adjacent to each other. In this example, the intermediate divisional pieces 510 are each provided with intermediate claw portions 5120, and also, the end portion divisional pieces 515 provided with the end portion claw portions 5170 described in the second embodiment above are provided. The intermediate claw portions 5120 of the intermediate divisional pieces 510 and the end portion claw portions 5170 of the end portion divisional pieces 515 are combined together, and thus, as shown in FIG. 7, the entire length of the corners 31*c* constituted by the plurality of inner core pieces 31 are covered by the intermediate claw portions 5120 and the end portion claw portions 5170. Due to the intermediate claw portions 5120 and the end portion claw portions 5170 being provided, it is possible to reduce cracks occurring in the resin mold portion 6. Also, depending on the length $L_{5170}$ of the end portion claw portions 5170, it is possible to accurately form a resin mold portion 6 that covers the outer circumferential surface of the magnetic core 3B and does not cover the outer circumferential surface of the coil 2.

The longer a length $L_{5120}$ of the intermediate claw portions 5120 in the axial direction of the coil 2 (here the protruding length from the body portion 512) is, the longer the length of the corners 31*c* of the inner core pieces 31 covered thereby is. For example, even in a case where the end portion divisional pieces 515 are not provided with end portion claw portions 5170, if the length $L_{5120}$ of the intermediate claw portions 5120 is set so that the intermediate claw portions 5120 come into contact with the end portion divisional pieces 515, it is possible to cover the entire length of the corners 31*c* of the inner core pieces 31 only using the intermediate divisional pieces 510 provided with the intermediate claw portions 5120. The length $L_{5120}$ of the intermediate claw portions 5120 may be adjusted according to the length $L_{5170}$ of the end portion claw portions 5170 so that only the intermediate claw portions 5120 or the intermediate claw portions 5120 and the end portion claw portions 5170 can cover preferably the entire length of the corners 31*c* of the inner core piece 31.

The shorter the length of the intermediate claw portions 5120 in the circumferential direction of the inner core pieces 31 is (here, the length in the circumferential direction of the body portion 512, which is hereinafter referred to as a circumferential length) within the range in which the intermediate claw portions 5120 can cover the corners 31*c* of the inner core pieces 31, the larger the contact areas between the inner core pieces 31 and the resin mold portion 6, and the larger the resin flow paths, which achieves excellent distribution. As shown in this example, if the circumferential length of the intermediate claw portions 5120 is roughly the same as the dimensions of the corners 31*c* of the inner core pieces 31, it is possible to reduce cracks occurring in the resin mold portion 6, while achieving effects such as excellent distribution of unsolidified resin, and improvements in mechanical characteristics of the magnetic core 3B due to the resin mold portion 6.

In this example, each intermediate claw portion 5120 has the same length $L_{5120}$ and the same circumferential length. However, it is possible to provide an intermediate claw portion 5120 that is different in at least one of the length $L_{5120}$ and the circumferential length. Also, in this example, two intermediate divisional pieces 510 are provided and these intermediate divisional pieces 510 have the same shape. However, the specifications (the number, the length $L_{5120}$, the circumferential length, and so on) of the intermediate divisional pieces 510 may differ from each other. For example, it is possible that one of the intermediate divisional pieces 510 is provided with an intermediate claw portion 5120 as in the first embodiment, and only the other intermediate divisional piece 510 is provided with the intermediate claw portions 5120. Even in this case, it is possible to cover the entire length of the corners 31*c* of the inner core pieces 31 using the intermediate claw portions 5120 and the end portion claw portions 5170 by adjusting the length $L_{5120}$ of the intermediate claw portions 5120 and the length $L_{5170}$ of the end portion claw portions 5170.

Fourth Embodiment

The reactor 1D according to the fourth embodiment includes the same magnetic core 3B as in the third embodiment, and an interposed member 5D that includes a plurality of intermediate divisional pieces 510 that are provided with the interposed protruding portions 5126 and the intermediate claw portions 5120, and the end portion divisional pieces 515 provided with the end portion claw portions 5170, as in the third embodiment. One difference between the reactor 1D according to the fourth embodiment and the third embodiment is the shape of the intermediate divisional pieces 510 included in the interposed member 5D. The outer circumferential surface of an inner core piece 31 of the magnetic core 3B included in the reactor 1D, to which an inner divisional piece 51 of the interposed member 5D is attached, has a shape with corners. An intermediate divisional piece 510 that is located at an intermediate position in the axial direction of the winding portions of the coil 2, from among the inner divisional portions 51 included in the reactor 1D, is provided with interposed protruding portions 5126 that have a plate shape so as not to protrude from the outer circumferential surfaces of inner core pieces 31 that are adjacent to each other, and intermediate claw portions 5120 that protrude from the corners of the interposed protruding portions 5126 so as to cover the corners 31*c* of the inner core pieces 31. The intermediate claw portions 5120 in this example are also provided with engagement portions 5121 that engage with other intermediate claw portions 5120 that are adjacent thereto. Furthermore, the end portion claw portions 5170 of the end portion divisional pieces 515 in this example are also provided with engagement portions 5171. Therefore, intermediate claw portions 5120 that are adjacent to each other engage with each other using the respective engagement portions 5121 thereof, and an intermediate claw portion 5120 and an end portion claw portion 5170 that are adjacent to each other engage with each other using the respective engagement portions 5121 and 5171 thereof.

As shown in FIG. 10, each intermediate divisional piece 510 in this example is provided with the body portion 512 that continuously covers inner core pieces 31 that are adjacent to each other, but the circumferential length of the body portion 512 is short. The dimensions of the body portion 512 are such that the body portion 512 can cover the lower surface of an inner core piece 31 and two corners that are connected to the lower surface. An interposed protruding portion 5126 that is constituted by a U-shaped flat plate member stands upright from the inner circumferential surface of the body portion 512. The projected contour of the flat plate member constituting the interposed projecting portion 5126 has a rectangular shape corresponding to the shape of the end surface of the inner core piece 31. The dimensions of the flat plate member are such that when the intermediate divisional piece 510 is attached to the inner core piece 31, the side surface of the interposed protruding portion 5126 is substantially flush with the outer circumferential surface (other than the chamfered portions) of the inner core piece 31. In such a reactor 1D according to the fourth embodiment, the outer circumferential surfaces of inner core pieces 31 that are adjacent to each other have large areas that are exposed from the inner divisional piece 51, particularly from the intermediate divisional piece 510, before the resin mold portion 6 is formed. Therefore, it is easy to form the resin mold portion 6 due to excellent flowability of unsolidified resin, and productivity is excellent. If the side surfaces of the interposed protruding portion 5126 are flush with the outer circumferential surfaces of an inner core piece 31, it can be expected that unsolidified resin will be more flowable. Also, it is possible to increase the contact areas between the inner core pieces 31 and the resin mold portion 6, and to increase the fixing strength of the resin mold portion 6 that fixes the magnetic core 3B. In this example, the peripheral portion of the interposed protruding portion 5126 is interposed between chamfered portions of the inner core pieces 31 that are adjacent to each other, and this peripheral portion is fixed by the resin mold portion 6. Therefore, it is also possible to improve the bonding strength of the inner core pieces 31 with the intermediate divisional piece 510, and to improve the fixing strength of the magnetic core 3B including the inner divisional pieces 51, using the resin mold portion 6.

Furthermore, the intermediate divisional piece 510 in this example is provided with intermediate claw portions 5120 that extend in opposite directions from each of the lower corners of the body portion 512 and each of the upper corners of the interposed protruding portions 5126. Furthermore, as described above, the end portion divisional pieces 515 in this example are provided with the end portion claw portions 5170. As with the interposed member 5C according to the third embodiment, the intermediate claw portions 5120 and the end portion claw portions 5170 cover substantially the entire length of the corners 31*c* of the inner core pieces 31, and thus the corners 31*c* and the resin mold portion 6 are prevented from coming into direct contact with each other. In particular, in this example, the claw portions 5120 and 5170 have the engagement portions 5121 and 5171 that engage with each other. Therefore, compared to an embodiment in which claw portions that are adjacent to each other abut against each other as in the third embodiment, it is easier to position intermediate divisional pieces 510 that are adjacent to each other, and an intermediate divisional piece 510 and an end portion divisional piece 515 in a manufacturing process, and keep a state of being attached to the inner core pieces 31. With such intermediate divisional pieces 510, it is possible to more reliably protect the corners 31*c* of the inner core pieces 31 when forming the resin mold portion 6.

The interposed protruding portions 5126 in this embodiment only need to have a shape that does not protrude from the outer circumferential surfaces of inner core pieces 31 that are adjacent to each other, and may be modified as appropriate. For example, each interposed protruding portion 5126 may be formed as at least one rod-shaped member or segment instead of as one U-shaped flat plate member. Also, the shapes and so on of the engagement portions 5121 and 5171 provided on the claw portions 5120 and 5170 may be modified as appropriate. FIG. 9 shows an example in which the claw portions 5120 and 5170 each have a step-like shape that includes a portion that has a different length, and the step-shaped portions constitute the engagement portions 5121 and 5171.

Modifications

At least one of following modifications is applicable to the above-described first to fourth embodiments.

(1) A case for housing the combined body 10 is provided, and the resin mold portion 6 is filled into the case.

If this is the case, the resin gap portions 60 are continuous with portions of the resin mold portion 6 filled between the inner surface of the case and the combined body 10. It is possible to use the case as a heat dissipation path by forming the case from metal or the like, to improve heat dissipation properties.

(2) The frame plate portions 52 are omitted.

If this is the case, if the thickness of the end surface restriction portion 5178 is increased, for example, the interval between the winding portions 2*a* and 2*b* and the inner end surfaces 32*e* of the outer core pieces 32 can be secured to be a predetermined size.

(3) The coil 2 provided with the pair of winding portions 2*a* and 2*b* is formed using one continuous winding wire 2*w*.

If this is the case, the coil 2 has a coupling portion that couples the winding portions 2*a* and 2*b* to each other. When the frame plate portions 52 are pressed when the resin mold portion 6 is formed, for example, this coupling portion can be sufficiently distanced from the turns of the winding portions 2*a* and 2*b* (e.g. the coupling portion is lifted up in FIG. 1).

(4) The coil 2 includes only one winding portion, and the magnetic core 3A has a well-known shape, such as the shape of a so-called EE core, ER core, or EI core.

(5) The winding wire 2*w* is a coated round wire that includes a round wire conductor and an insulative coating.

(6) The winding portions of the coil 2 are cylindrical members whose end surfaces have a ring-like cylindrical shape, a cylindrical shape without corners such as an elliptical shape or a race track shape, or a cylindrical shape with corners such as a square shape or another polygonal shape (in particular, the second and third embodiments).

(7) The magnetic core 3A includes, as core pieces, U-shaped members that include portions that are located inside the winding portions 2*a* and 2*b* and portions that are located outside the winding portions 2*a* and 2*b*.

(8) The cutouts 329 of the outer core pieces 32 are omitted. Alternatively, the cutouts 329 of the outer core pieces 32 and the pin grooves 59 of the frame plate portions 52 are both omitted.

(9) The resin mold portion 6 is omitted.

If this is the case, it is possible to realize a reactor that has air gaps between core pieces between which the interposed protruding portions 5126 are interposed. If a banding band or the like is tied around the combined body 10, the components thereof are unlikely to come apart, and can be easily handled. According to this embodiment, a reactor can be manufactured by attaching the coil 2, the magnetic core 3A and so on, and the interposed member 5A and so on to each other.

(10) The plurality of inner divisional pieces 51 that are arranged in the winding portions 2*a* and 2*b* include one intermediate divisional piece 510 and a pair of end portion divisional pieces 515.

If this is the case, as described in the fourth embodiment, the intermediate divisional piece 510 and the end portion divisional pieces 515 can each be provided with an engagement portion at an end portion thereof.

The present disclosure is not limited to these examples, and is specified by the scope of claims. All changes that come within the meaning and range of equivalency of the claims are intended to be embraced therein.

The invention claimed is:

1. A reactor comprising:

a coil that includes a winding portion;

a magnetic core that includes a plurality of core pieces that are located inside and outside the winding portion, and one or more gap portions that are interposed between core pieces that are adjacent to each other;

an interposed member that is interposed between the coil and the magnetic core; and a resin mold portion that covers at least a portion of an outer circumferential surface of the magnetic core without covering an outer circumferential surface of the winding portion so that the outer circumferential surface of the winding portion is exposed, wherein the interposed member includes: a plurality of inner divisional pieces that are interposed between an inner circumferential surface of the winding portion and an outer circumferential surface of the magnetic core, and are located so as to be separated from each other in an axial direction of the winding portion; and a frame plate portion that is independent of the inner divisional pieces, and is interposed between an end surface of the winding portion and an outer core piece included in the magnetic core, the outer core piece being located outside the winding portion, the plurality of inner divisional pieces include: at least one intermediate divisional piece that is located at an intermediate position in an axial direction of the winding portion, keeps an interval between the core pieces that are adjacent to each other, and is provided with interposed protruding portions that form at least one of the gap portions; and a pair of end portion divisional pieces that sandwich the intermediate divisional piece and are located at end surface sides of the winding portion, the intermediate divisional piece includes: a body portion that continuously covers portions of the outer circumferential surfaces of the core pieces that are adjacent to each other, the interposed protruding portions standing upright on an inner circumferential surface of the body portion; and a cutout portion from which the outer circumferential surfaces of the core pieces that are adjacent to each other are partially exposed so that the body portion is disconnected in a circumferential direction of the outer circumferential surfaces, and the end portion divisional pieces are each provided with: a ring-shaped body portion that surrounds an outer circumferential surface of a core piece in a circumferential direction thereof; and end portion-side protruding portions that keep an interval between the outer circumferential surface of the core piece and an inner circumferential surface of the ring-shaped body portion, the frame plate portion is provided with: a through hole from which an end surface of an inner core piece included in the magnetic core is exposed, the inner core piece being located inside the winding portion; and a portion that is interposed between the inner core piece and the outer core piece, and forms a predetermined gap between the inner core piece and the outer core piece, and the resin mold portion includes: a resin gap portion that is located between the core pieces that are adjacent to each other and constitutes at least another one of the gap portions; an intermediate covering portion that is continuous with the resin gap portion and fills a level difference between an exposed portion of the outer circumferential surfaces of the core pieces that are adjacent to each other and the body portion, the exposed portion being exposed from the cutout portion; an end portion covering portion that is continuous with the intermediate covering portion and is interposed between the outer circumferential surface of the core piece and the inner circumferential surface of the ring-shaped body portion; and a resin gap portion that is located between the inner core piece and the outer core piece.

2. The reactor according to claim 1, wherein an outer circumferential surface of at least one of the core pieces to which the inner divisional pieces are attached has a shape with corners, and the end portion divisional pieces are each provided with end portion claw portions that protrude from the ring-shaped body portion surrounding the outer circumferential surface of the core piece with the corners in the circumferential direction thereof, so as to cover the corners of the core piece.

3. The reactor according to claim 1, wherein an outer circumferential surface of at least one of the core pieces to which the inner divisional pieces are attached has a shape with corners, and the intermediate divisional piece includes intermediate claw portions that protrude from the body portion so as to cover the corners of the core piece.

4. The reactor according to claim 1, wherein an outer circumferential surface of at least one of the core pieces to which the inner divisional pieces are attached has a shape with corners, and the intermediate divisional piece is provided with: the interposed protruding portions that each have a plate shape that does not protrude from the outer circumferential surfaces of the core pieces that are adjacent to each other; and intermediate claw portions that protrude from corners of the interposed protruding portions so as to cover the corners of the core piece.

5. The reactor according to claim 3, wherein the intermediate claw portions are provided with engagement portions that engage with other claw portions that are adjacent thereto.

* * * * *